US005775156A

United States Patent [19]

De Rossi et al.

[11] Patent Number: 5,775,156

[45] Date of Patent: Jul. 7, 1998

[54] METHOD AND APPARATUS IN A BENDING MACHINE

[75] Inventors: Roberto De Rossi, Cologna Veneta; Luigi Patuzzi, Monteforte D'Alpone, both of Italy

[73] Assignee: Balaxman Oy, Kauhava, Finland

[21] Appl. No.: 386,356

[22] Filed: Feb. 9, 1995

[30] Foreign Application Priority Data

Feb. 10, 1994 [FI] Finland ..... 940613

[51] Int. Cl.[6] ..... B21D 11/04

[52] U.S. Cl. ..... 72/319; 72/413; 72/446; 72/478

[58] Field of Search ..... 72/478, 319, 320, 72/321, 322, 323, 448, 446, 413; 259/164

[56] References Cited

U.S. PATENT DOCUMENTS

| | | | |
|---|---|---|---|
| 4,532,792 | 8/1985 | Hongo | 72/319 |
| 4,660,402 | 4/1987 | Hongo . | |
| 4,722,214 | 2/1988 | Hayashi et al. . | |
| 4,761,985 | 8/1988 | Klingesberger . | |
| 4,765,171 | 8/1988 | Klingesberger . | |
| 4,856,315 | 8/1989 | Salvagnini . | |
| 4,875,171 | 10/1989 | Fujioka et al. . | |
| 4,930,332 | 6/1990 | Hongo . | |
| 5,134,873 | 8/1992 | Miyagawa et al. | 72/478 |
| 5,474,437 | 12/1995 | Kuroyone | 72/319 |

FOREIGN PATENT DOCUMENTS

| | | | |
|---|---|---|---|
| 385 690 | 5/1988 | Australia . | |
| 0 105 091 | 4/1984 | European Pat. Off. . | |
| 16731 | 1/1983 | Japan | 72/319 |
| 148021 | 9/1983 | Japan | 72/319 |
| 207419 | 8/1988 | Japan | 72/478 |
| 5-212446 | 8/1993 | Japan | 72/478 |

OTHER PUBLICATIONS

Patent Abstracts of Japan, vol. 7, No. 269, (M-259), 58-148021, Appl. No. 57-28871, Yoshio Sugawara.

*Primary Examiner*—David Jones
*Attorney, Agent, or Firm*—Louis Woo

[57] ABSTRACT

The invention relates to a method and apparatus for adjusting the width of the bending jaws in a bending machine. The total width (L) of the bending jaws is formed by using jaw parts and edge pieces in the following manner:

a first set ($R_1$) is elected to form a group of jaw parts of different widths for so-called fine adjustment, one at a time ($R_{1n}$) being at the operational point (T) of the bending jaws, a second set ($R_2$) is elected to form a group of jaw parts with identical width and to be separate from the edge pieces ($RK_1$, $RK_2$) for so-called coarse adjustment, wherein the width of the bending jaws required at a time is elected according to the equation $$L=R_{1n}+N * R_{2i}+C,$$

wherein

L=the width of the bending jaws, $R_{1n}$=the width of the jaw part (n=0 . . . M) elected from the first set ($R_1$), N=the width of the jaw parts of the second set ($R_2$), i.e. a constant, $R_{2i}$=the number (i=0 . . . k) of jaw parts of the second set ($R_2$) at the operational point (T) of the bending jaws, and C=a constant, comprising the parts with a constant width included in the total width of the bending jaws, i.e. preferably at least the total width ($C_R$) of the edge pieces ($RK_1$, $RK_2$) and the total width ($C_L$) of the locking parts (LO) between the first and second sets.

16 Claims, 17 Drawing Sheets

I
II
R1
R1m
17
EV
16
1
R2i
S
R1n
R2i
R1m
17
16
18a 18
20
19
18
180°
22
VA1

16
R1n
R1n
R1m

16
VA1
19
21
21a
180°

EV
1
22
R2i
R1m·R1n
EV
1
R1n
R1n

EV
R1n
R1
19
180°
R1m
S

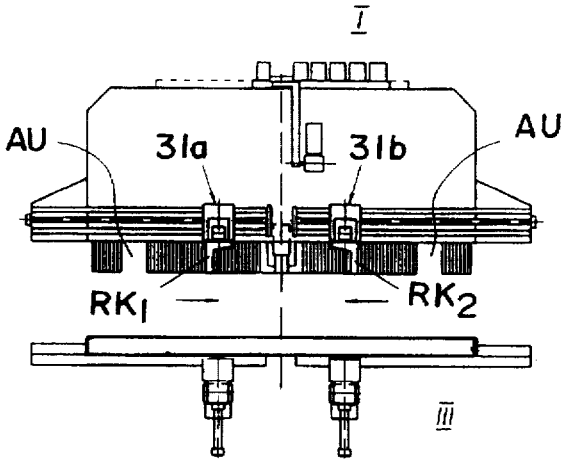
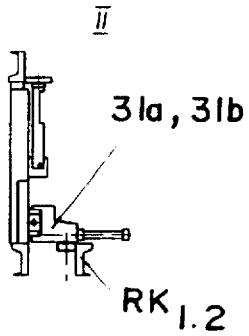
FIG. 11f
FIG. 11g
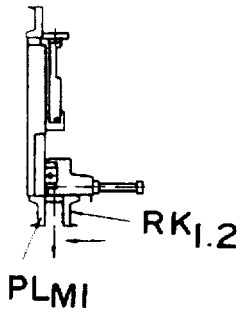
FIG. 11h
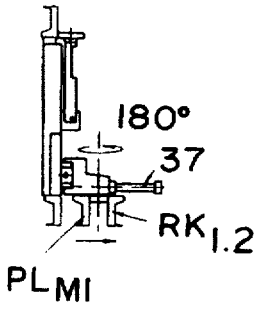
FIG. 11i
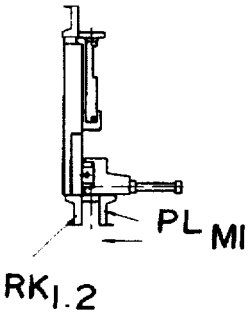
FIG. 11j
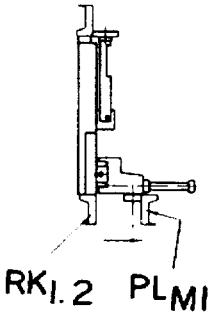
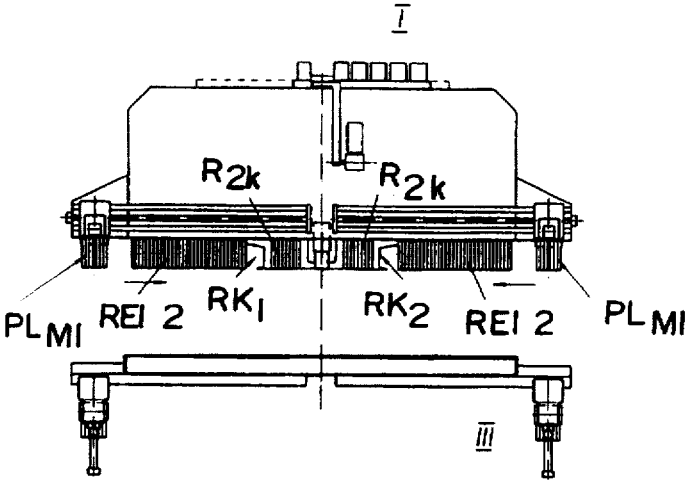
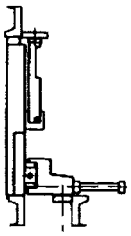
FIG. 11k
FIG. 11l
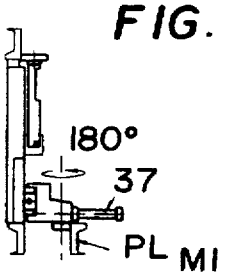
FIG. 11m
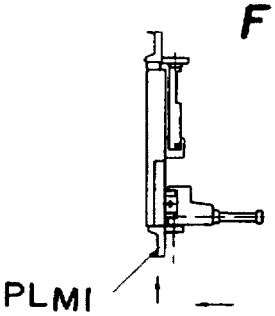
FIG. 11n
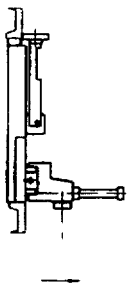

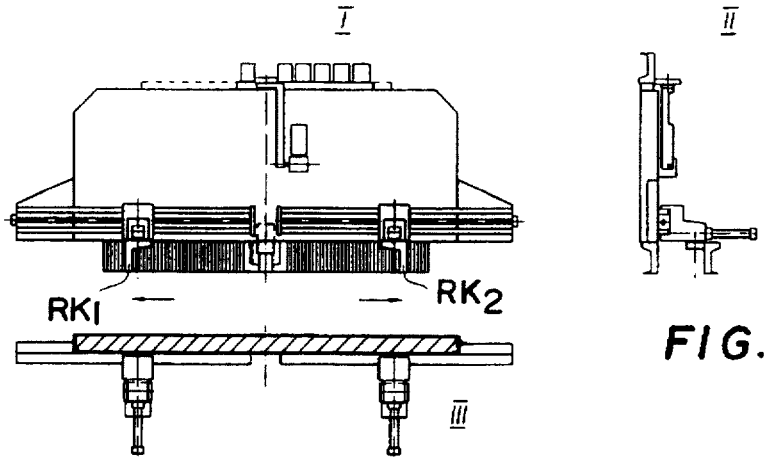
FIG. 12g
FIG. 12h
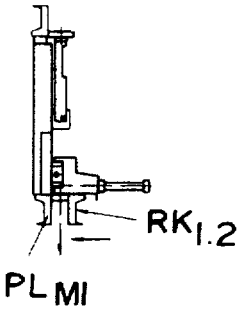
FIG. 12i
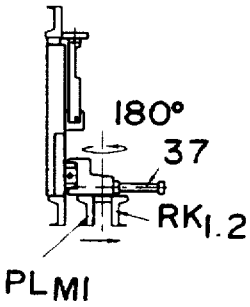
FIG. 12j
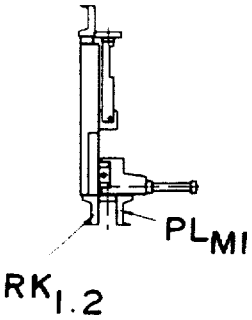
FIG. 12k
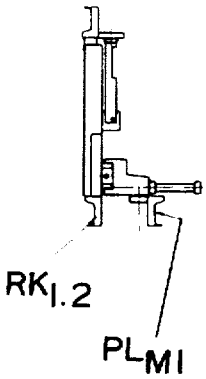
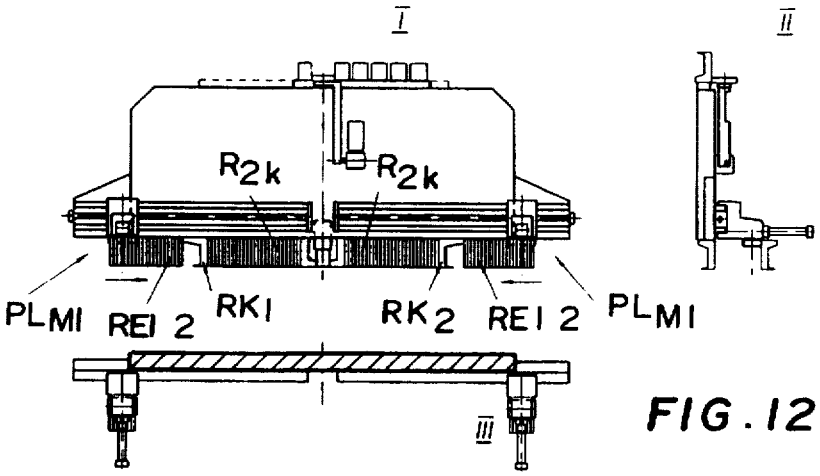
FIG. 12l
FIG. 12m
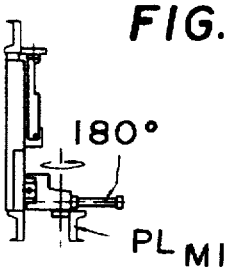
FIG. 12n
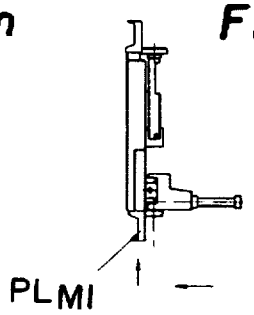
FIG. 12o
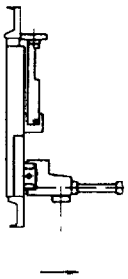

METHOD AND APPARATUS IN A BENDING MACHINE

FIELD OF THE INVENTION

The invention relates to a method for adjusting the width of the bending jaws of a bending machine. The bending jaws of the bending machine applying the method comprises two sets of jaw parts, which are, for adjusting the width, moved and/or exchanged from an operational point to a non-operational point, these points being preferably in connection with the bending machine and vice versa, wherein the first set is placed in the middle of the bending jaws, and the second set is placed at both sides of the first set, wherein the edges of the bending jaws are provided with edge pieces which are part of the bending jaws and define the total width of the bending jaws.

BACKGROUND OF INVENTION

From patent publications, several solutions are known for adjusting the width of the bending jaws of a bending machine. As to the state of art, reference can be made e.g. to the publication EP-105091, which discloses a tool length changing device which is essentially similar to that presented above. The bending jaws comprise two sets of jaw parts, whereby the first set comprises a number of narrow plates corresponding to the shape of the bending jaws, the number of plates in connection with the bending jaws being adjustable, whereby said plates are used for fine adjustment of the width of the bending jaws. At both sides of the first set, the second set of jaw parts is provided, forming the unit for coarse adjustment of the width of the bending jaws, whereby each piece of the second set, at its end face, which extends substantially outwards from the bending jaws in the longitudinal direction of the bending jaws, comprises a protruding arrangement intended for making possible the function of the bending jaws at the stage of bending particularly the two last edges of the four edges of the sheet. The above-presented method and apparatus are relatively difficult to apply to practice particularly because the edge pieces are usually relatively wide in the longitudinal direction of the bending jaws, whereby for fine adjustment, a relatively large number of plates is needed, from which a certain group must be selected for fine adjustment. Furthermore, this construction is expensive, because it contains numerous specially made edge pieces.

On the state of art, reference is also made to the publications U.S. Pat. No. 4,722,214, U.S. Pat. No. 4,761,985, U.S. Pat. No. 4,875,171, and U.S. Pat. No. 4,856,315. These publications disclose solutions of prior art. In general, they have the disadvantages of the device of EP-105091 presented above, and they are very complicated in construction and function.

It is the purpose of this invention to present a method whereby the disadvantages of prior art can be eliminated to a maximum extent and thus to improve the state of art in adjusting the width of the bending jaws of a bending machine. The solution according to the invention is particularly related to the applications of a bending machine using automatic tool change techniques.

SUMMARY OF INVENTION

For achieving the purposes mentioned above, the method of the invention is primarily characterized in that the width of the bending jaws is defined in the following manner:

the first set is elected to form a group of jaw parts of different widths for so-called fine adjustment, one jaw part being at the operational point of the bending jaws at a time, the second set is elected to form a group of jaw parts having identical width and being separate from the edge pieces for so-called coarse adjustment, wherein the width of the bending jaws required at a time is elected according to the equation $$L=R_{1n}+N * R_{2i}+C \quad (1)$$

wherein

L=the width of the bending jaws, $R_{1n}$=a jaw part (n=0 . . . M) elected from the first set, N=the width of the jaw parts of the second set, i.e. a constant, $R_{2i}$=the number (i=0 . . . k) of jaw parts of the second set at the operational point of the bending jaws, and C=a constant, comprising the parts with a constant width included in the total width of the bending jaws, i.e. preferably at least the total width of the edge pieces and the total width of the locking parts between the first and second sets.

The present solution provides the advantage that the width of the bending jaws of the bending machine can be adjusted in a quick and reliable manner by using simple functional parts. The first set of jaw parts makes up a set for so-called fine adjustment. Thus their difference in width is preferably defined to be constant, whereby the interval for adjusting the total width is equal to the difference in width of the jaw parts of the first set. On the other hand, the width of the jaw parts of the second set is also elected to be constant, and they are used for so-called coarse adjustment of the total width of the bending jaws. Thus, when applying the method, the number of jaw parts of the second group is elected first to obtain a so-called coarse measurement range for the total width. After this, that jaw part is selected from the first set which is most suitable for obtaining the total width of the bending jaws needed for the bending purpose. The method is particularly advantageous, because the jaw parts of the second set are simple plates, and there are only two edge pieces that make up a kind of a third set, the width being a constant to be considered in determining the total width of the bending jaws.

The method of the invention can be applied in a number of ways, and some of these applications are presented in the appended dependent claims on the method.

The invention relates also to an apparatus for adjusting the width of the bending jaws of a bending machine. The characteristic features of this apparatus are primarily set forth in the characterizing part of the appended independent claim on the apparatus. The apparatus makes it possible to apply the method of the invention in an advantageous manner.

Some advantageous embodiments of the apparatus are presented in the appended dependent claims on the apparatus.

BRIEF DESCRIPTION OF THE FIGURES

In the following, the invention will be described in more detail with reference to the appended drawings. In the drawings.

DETAILED DESCRIPTION OF INVENTION

Figure 2:
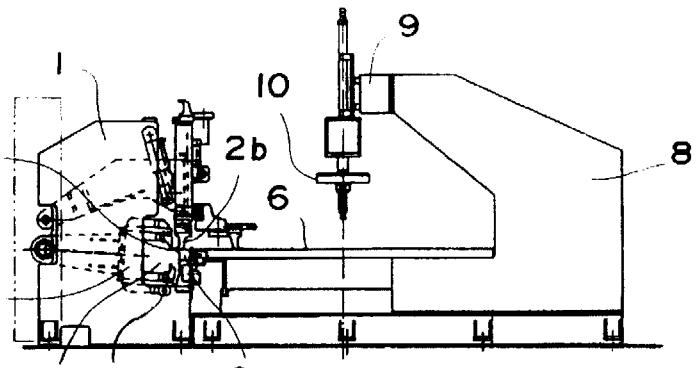
FIGS. 1 to 3 illustrate a bending machine applying the method and apparatus of the invention, seen from two sides and from above.
Figure 1:
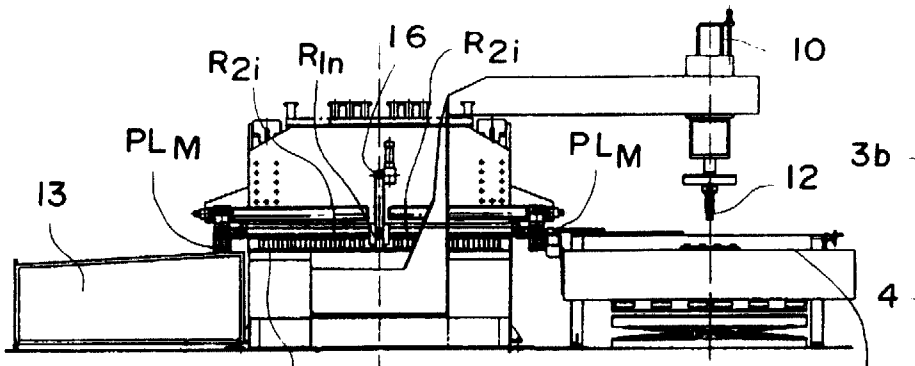
Figure 3:
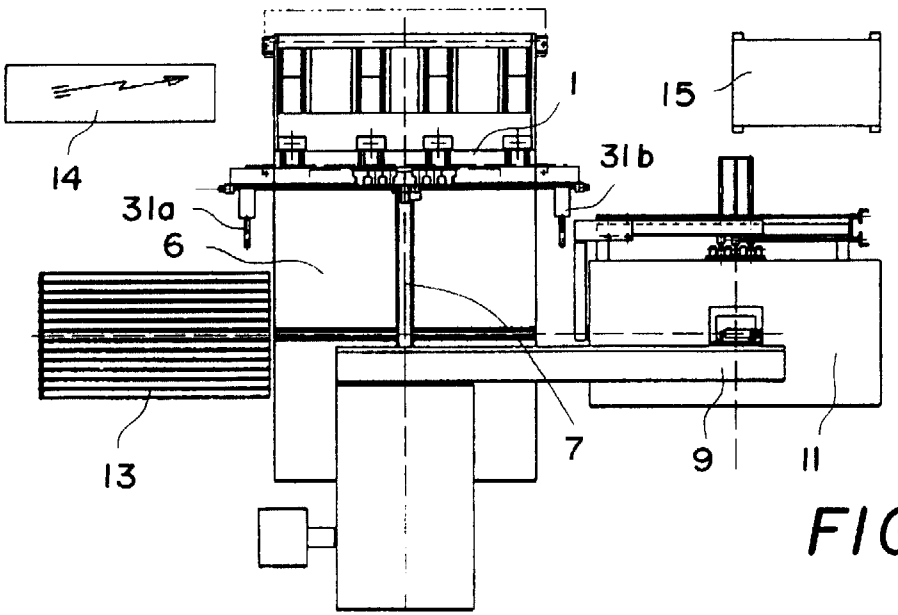

FIGS. 1 to 3 illustrate a bending machine for applying the method and apparatus for adjusting the width of the bending jaws of a bending machine according to the invention. The bending machine comprises as main parts a frame 1, bending jaws 2*a*, 2*b* in the frame 1, of which the lower jaw 2*a* being stationary in the frame 1 and the upper jaw 2*b* being movable in the vertical direction for pressing the sheet to be bent between the bending jaws 2*a*, 2*b*. The invention is applied particularly in connection with the upper jaw 2*b*. Further, the bending machine comprises a movable bending jaw arrangement 3*a*, 3*b* in a frame structure 4 articulated in the frame 1 and having a C-form when seen in a cross-section perpendicular to the longitudinal direction of the bending machine, whereby the sheet between the bending jaws 2*a*, 2*b* in the frame 1 can be bent both from above and from below either by a lower bending jaw 3*a* or by an upper bending jaw 3*b* of the bending jaw arrangement 3 in the gap 5 of the C-formed frame 4. The bending machine is also provided with a support table 6 for the sheet to be bent. The support table 6 is equipped with a transfer device 7 for moving the sheet to be bent in a linear direction towards and away from the bending jaws 2*a*, 2*b*; 3*a*, 3*b*.

In the embodiment shown in FIGS. 1 to 3, there is also a transfer system for the sheets to be bent, comprising a frame part 8 provided with a horizontal arm 9. In this arm, a movable gripping device 10 is arranged for gripping a pile of sheets placed on the side of the frame 8, the uppermost sheet 11 thereof, from above, e.g. by a suction pad arrangement 12 in connection with the gripping device 10. In addition to the vertical movement, the gripping device 10 is arranged to rotate around a vertical axis, whereby it can, when operating on the support table 6, always turn the edge of the sheet 11 to be bent next in alignment with the longitudinal direction of the bending jaws 2*a*, 2*b*; 3*a*, 3*b* upon the many different stages of bending are being carried out. After the sheet 11 has been bent a pre-determined series of times, it is transferred onto the transfer table 13 and to further processing of the bent sheet. FIGS. 1 to 3 also show a main distribution board with the reference number 14 and a central unit with the reference number 15.

The operations of the bending machine and the devices connected therewith are automated, whereby the bending operations of the sheet to be bent and the readjustments between the bending operations are carried out on the basis of instructions by the programmed automatics to the actuator. In many practical embodiments, the width of the bending jaws must be narrowed particularly in connection with bending the third and fourth edges of a rectangular sheet in order to be able to lift the bending jaw, particularly the upper bending jaw 2*b* in the frame 1, without being prevented by the first and second edge bending of the sheet. For this purpose, the bending jaw used in the method of the invention can be programmed in a way that the jaw part $R_{1n}$ of the first set is temporarily removed from the connection of the bending jaw to an exchange position where it does not prevent the jaws $R_{2i}$ of the second set from moving towards each other, whereby the width of the bending jaws is made temporarily narrower than its operational width and jaws $R_2$ can be removed upwards without being prevented by the first and second edge bendings, and the bent sheet can thus be removed from between the clamp jaws.

The purpose of this invention is particularly to present a method and an apparatus, whereby upon bending a sheet in several stages, the most critical width of the bending jaws, i.e. the width of the upper, vertically movable bending jaw 2*b* (the clamp jaw) of the bending machine, can be adjusted by degrees. The basic idea of the invention is schematically illustrated particularly in FIG. 4. The bending jaw comprises:

a) two sets ($R_1$, $R_2$) of bending jaws, which are, for adjusting the width of the bending jaws, moved and/or exchanged from an operational point T to a non-operational point ET, and b) parts of standard width, the most important parts being the edge pieces $RK_1$, $RK_2$ at both ends of the bending jaw, forming some kind of a third set.

Figure 4:
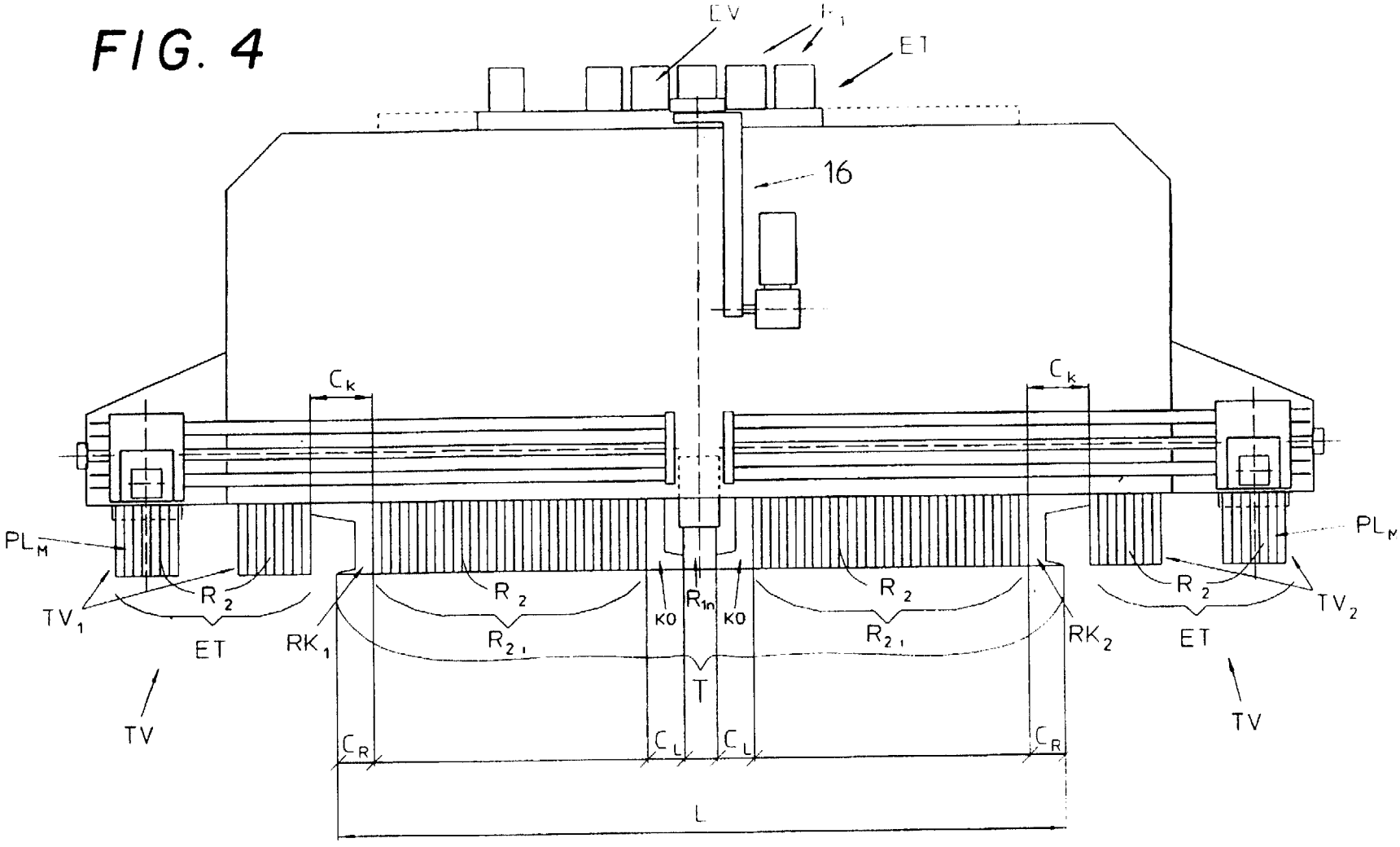
FIGS. 4 to 6 illustrate schematically the operating principle of the method of the invention.

The non-operational points are preferably in connection with the bending machine and form a first storage EV for the jaw parts of the first set $R_1$ and a second storage TV ($TV_1$, $TV_2$) for the jaw parts of the second set $R_2$. The second storage TV consists of two parts, being placed on both sides of the operational width L of the bending jaws. According to the invention, the jaw part $R_{1n}$ of the first set in the operational position or region T is placed in the middle of the bending jaws, and the jaw parts $R_{2i}$ of the second set in the operational position T are placed on both sides of the jaw part $R_{1n}$ of the first set. At the edges of the bending jaws, there are also edge pieces $RK_1$ and $RK_2$ of the bending jaws, determining the total width of the bending jaws. As shown in FIG. 4, the width L of the bending jaws is determined by electing a certain jaw part $R_{1n}$ from the first set. The first set $R_1$ is elected to comprise a group of jaw parts of the first set with different width, intended for fine adjustment of the width of the bending jaws. Only one ($R_{1n}$) of the jaw parts of the first set ($R_1$) is in operational connection with the bending jaws at a time. The second set $R_2$ is elected to comprise a group of plate-like jaw parts with equal width, whereby the jaw parts $R_{2i}$ of the second set in the operational position are intended for coarse adjustment of the width of the bending jaws. The total width L of the bending jaws is formed by a formula which is programmed in the programming logistics of the bending machine according to the dimensions of the quantities affecting the width of the jaw parts $R_1$, $R_2$ and of the edge parts $RK_1$, $RK_2$ etc. and according to the strategy of electing the width of the bending jaws. The total width L is elected according to the formula presented above, using the references of FIG. 4. Thus particularly the constant C in the equation presented on the width of the bending jaws is substantially composed of four partial constants, which are the widths $C_R$ of the edge pieces $RK_1$ and $RK_2$ and the widths $C_L$ of the locking pieces of the center part KO.

Figure 5:
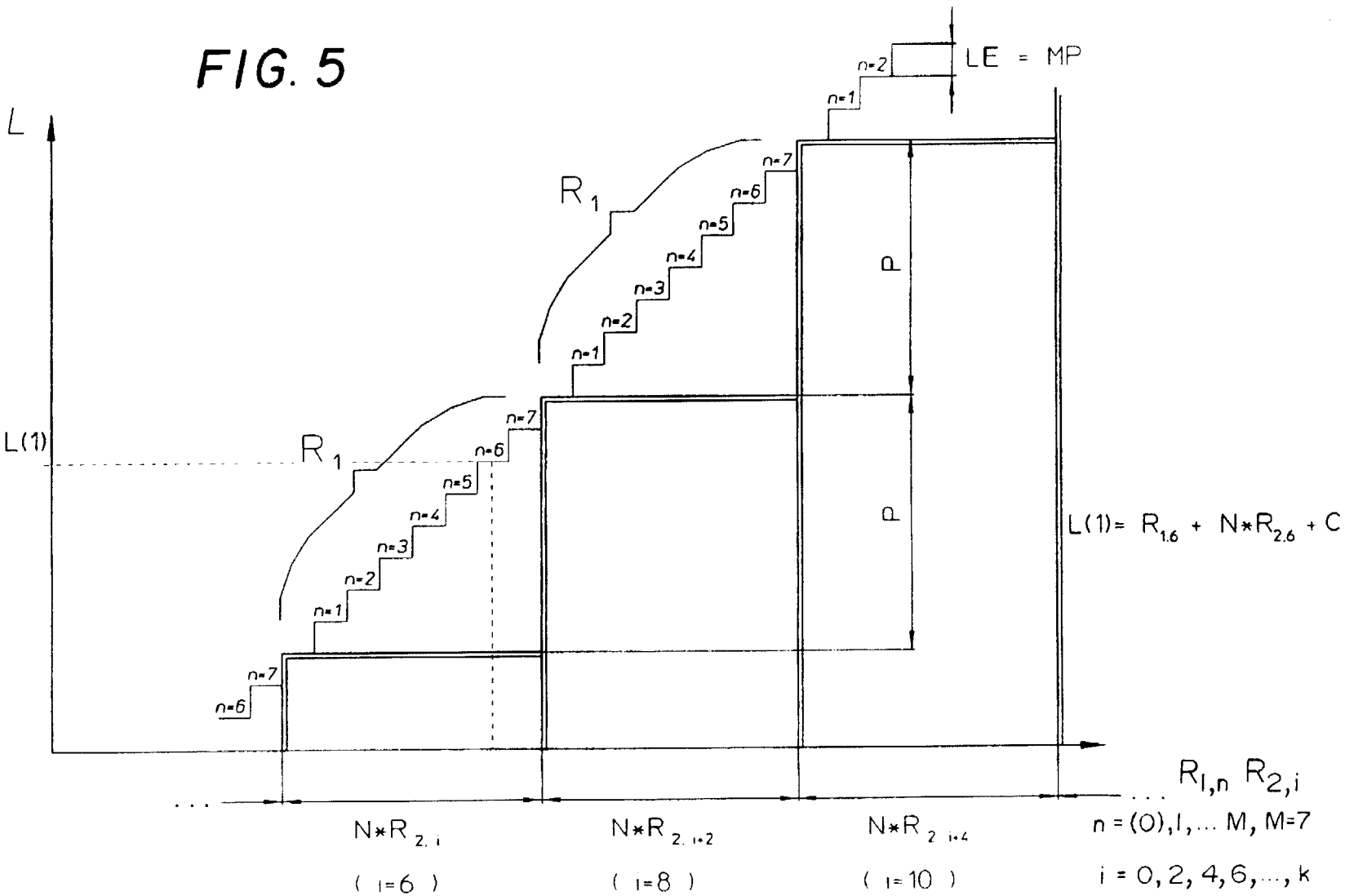

FIG. 5 shows the operating principle of the method of the invention in a schematic drawing L=f ($R_1$, $R_2$). Thus the coarse adjustment is made by election of the number of jaw parts $R_{2i}$ of the second set $R_2$ in the operational position T, whereby the bending width is gradual P for the coarse adjustment, as shown in FIG. 5. For the range of each coarse adjustment step P, a certain jaw part $R_{1n}$ can be elected from the first set $R_1$, in this example from seven jaw parts (n=1 . . . M, M=7). The difference LE in the widths of successive jaw parts of the first set is constant. This width difference constant LE is divided evenly in the range of the coarse adjustment step P so that the minimum deviation MP of the total width L of the bending jaws is the difference LE in the widths of jaw parts of the first set $R_1$. In FIG. 5, the minimum deviation is indicated with the reference MP. This gives a series of ascending or descending steps of functional total widths L of the bending jaws, from which the desired total width L can be selected on the basis of the dimensions of the first and second set.

For example, the total width L(1) of a bending jaw shown in FIG. 5 is, using the index markings of FIG. 5: the jaw part $R_{1,6}$ is elected from the first set (n=6) and the number of jaw parts of the second set is $R_{2,6}$ (i=6). The width of each jaw part of the second set $R_2$ is N. It should be noted that the rarely used minimum total width L of the bending jaws corresponds to the width of the constant C in Formula 1, when $R_{1n}$=0 and $R_{2i}$=0.

In the application of the operational principle shown in FIG. 5, the number of jaw parts of the second set $R_{2i}$ is thus elected to be even, and the jaw parts of the second set $R_2$ are then placed symmetrically on both sides of the bending jaw structure so that the jaw part $R_{1n}$ of the first set and the center part KO are placed centrally in the width of the bending jaws. Consequently, in the equation on the total width of the bending jaws (Formula 1), the index i in the term $R_{2i}$ is an even number and the step P=2 * N.

Figure 6:
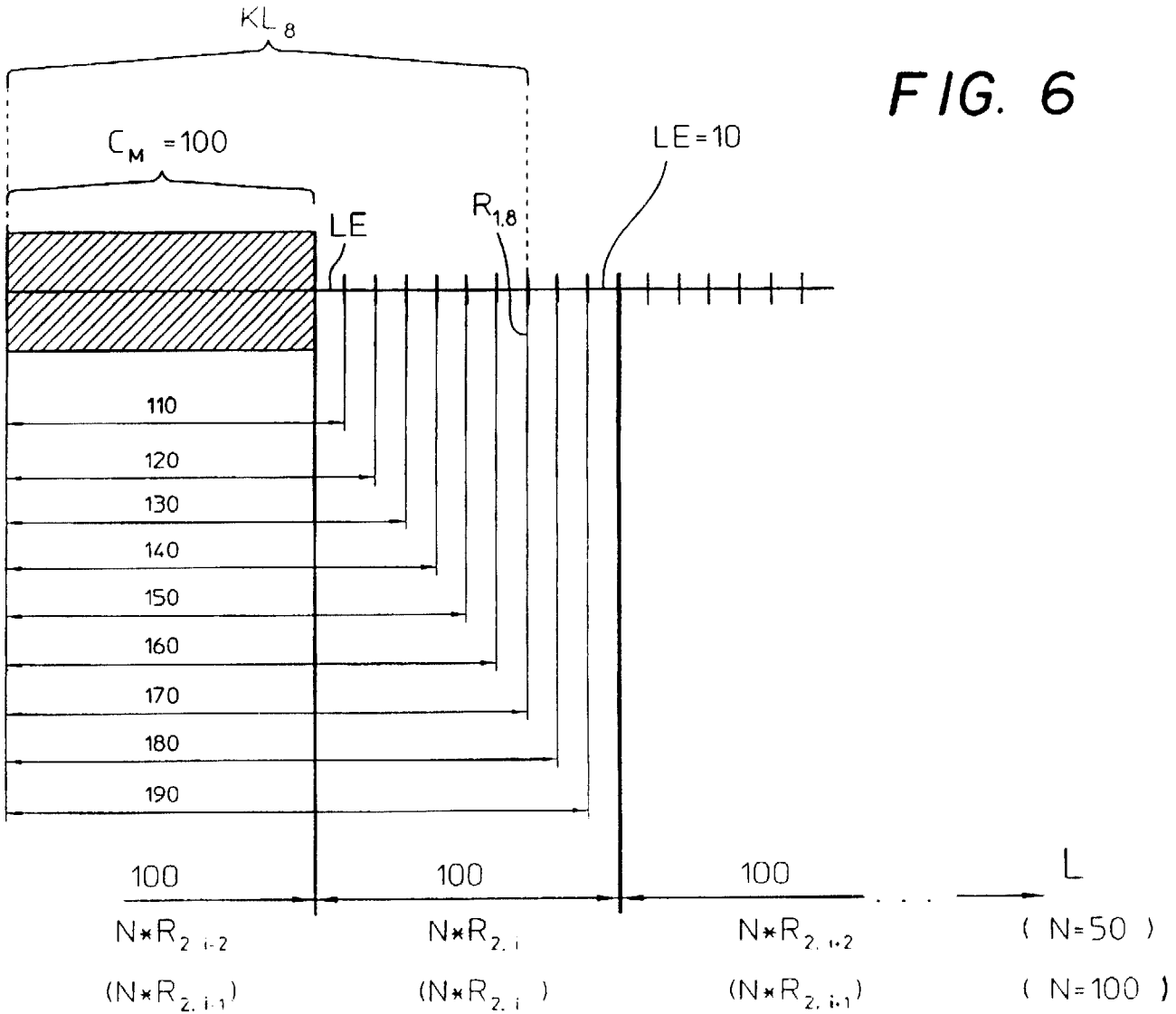

As shown particularly in FIG. 6, the number M of jaw parts of the first set $R_1$ can be elected so that $$M = \frac{N}{LE} \text{ or} \qquad \text{(Formula 2)}$$

$$M = \frac{2 * N}{LE}. \qquad \text{(Formula 3)}$$

Consequently,

M=number of jaw parts in the first set $R_1$,

N or 2*N=width of each jaw part or two jaw parts of the second set $R_2$, and

LE=constant difference in the width of successive jaw parts, e.g. $R_{1,n}$ and $R_{1,n+1}$, in the series of jaw parts of the first set $R_1$.

Further using the references of FIG. 6, it can be stated that the width of jaw parts of the first set $R_1$ can be elected so that it complies with the condition $$KL_n = C_M + K_{(k)} * LE \qquad (4),$$

wherein $KL_n$=the width of a certain jaw part $R_{1,n}$ of the first set $R_1$, wherein n receives a value from 1 . . . M, M being the number of jaw parts, $C_M$=a constant measurement, i.e. the basic width of jaw parts of the first set $R_1$, $K_{(k)}$=a coefficient that receives in the formula a value 0, 1, 2, . . . to M−1, M being the number of jaw parts, and LE=the constant difference in the width of successive jaw parts, e.g. $R_{1,n}$ and $R_{1,n+1}$, in the series of jaw parts of the first set $R_1$.

This solution gives the advantage that a continuous constant difference LE in the width is obtained as shown in FIG. 5, although moving one or several steps upwards or downwards in the coarse adjustment; also, the number of jaw parts can be minimized. Particularly FIG. 6 shows a variation in which N or 2*N=the numerical value 100 (i.e. the width of jaw parts of the second set has the numerical value of either 100 or 50) and LE=the numerical value 10, from which it follows that there are a total of ten jaw parts in the first set $R_1$ (Formulas 2 and 3). Further, if the constant $C_M$=the numerical value 100, the width of the first jaw part $R_{1,1}$ of the first set $R_1$ is $KL_1$ =the numerical value 100. Consequently, using the markings of FIG. 6, e.g. the width $KL_8$ of the eighth jaw part $R_{1,8}$ of the first set $R_1$ is 170. When electing the width of the constant $C_M$, particular attention is paid to the temporary needs for narrowing the total width L when the bending jaw is lifted in connection with bending the third and fourth edges of the sheet to be bent. In calculation, the constant $C_M$ can be included in the constant C of the equation for defining the width of the bending jaws (Formula 1).

Further according to the method, the total width $C_K$ of the edge piece $RK_1$, $RK_2$ (FIG. 4), $C_K$>$C_R$) in the longitudinal direction of the bending jaws is elected to substantially correspond to, or to be smaller than, the joint width LM * N of jaw parts of the jaw part series $PL_M$ to be removed from the second set $R_2$. If necessary, the method is used, in connection with changing the total width L of the bending jaws, for removing a series of jaw parts of the second set $R_2$ (jaw part series $PL_M$) from both ends of the bending jaws and placing the edge pieces $RK_1$, $RK_2$ in the openings thus formed, these being thus preferably wider than the width $C_K$ of the edge pieces in the longitudinal direction of the bending jaws. Naturally prior to this operation, the jaw parts of the second set $R_2$, removed for the previous width adjustment of the bending jaws, are returned to connection with the bending jaws, at the removal point of the edge pieces $RK_1$, $RK_2$, and/or the jaw parts of the second set $R_2$ are compressed into a uniform set. Thus, between the width $C_K$ of the edge pieces $RK_1$, $RK_2$ and the jaw part series $PL_M$ of the second set $R_2$, there is a relation $$LM * N > C_K \qquad (5),$$

wherein LM is the number of those jaw parts in the second set $R_2$ which, in connection with each adjustment of the width of the bending jaws, are removed as a series $PL_M$ of adjacent jaw parts and wherein N is the width of each plate-like jaw part with standard thickness of the second set $R_2$ in the longitudinal direction of the bending jaws, i.e. a constant. For example, if $C_K$=the numerical value 700 and N=the numerical value 100, there is e.g. in connection with the second storage $TV_1$ and $TV_2$ in certain embodiments of the invention a jaw part series $PL_M$ consisting of seven jaw parts on both sides of the bending jaws of the bending machine, at the non-operational position ET (FIG. 4).

Figures 7A, 7B, 7C, 7D, 7E, 7F:
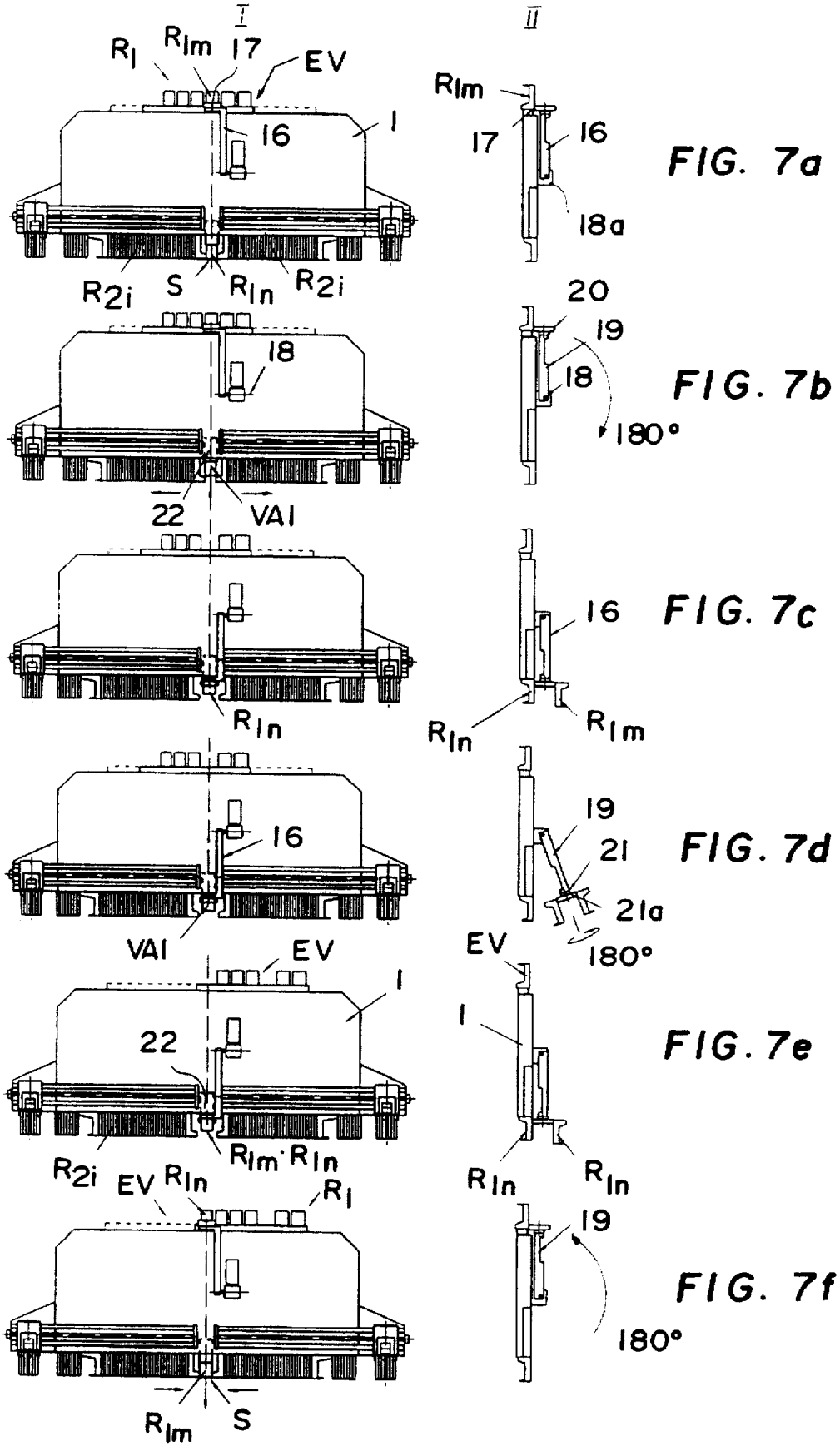
FIGS. 7 to 8 show schematically two alternative embodiments of exchanging jaw parts of the first set in connection with adjusting the total width of the bending jaws as steps a to f, whereby the left-hand series I in each partial figure a to f shows the respective step as seen from the side of the bending machine in a direction perpendicular to the longitudinal direction of the bending jaws, and the partial figure II shows the respective situation as seen in a direction perpendicular to the direction of the series I (in the longitudinal direction of the bending jaws).
Figures 8A, 8B, 8C, 8D, 8E, 8F:
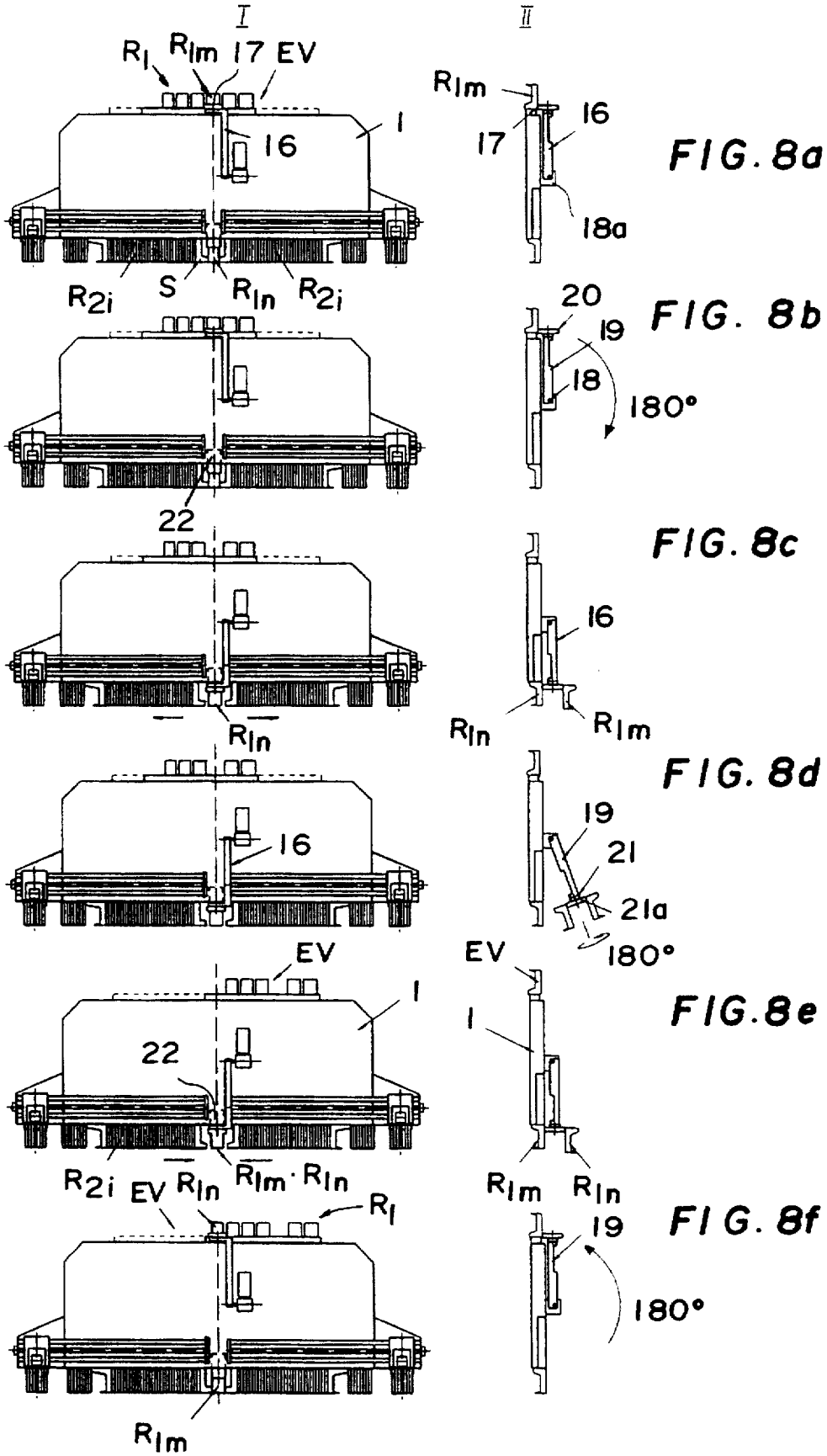

Particularly in FIGS. 7 and 8, the exchange of a jaw part of the first set $R_1$ is shown in two alternative embodiments. The jaw parts of the first set $R_1$ are placed in connection with the first storage EV. The jaw part $R_{1n}$ in the operational position in connection with the bending jaws is exchanged by a transfer device 16 effective between the first storage EV and substantially the location S of the jaw part $R_{1n}$. In FIG. 7, the exchange of the jaw part of the first set is shown in steps a to f. Thus the partial figure a shows the starting point when the previous bending programme is finished and the next bending programme to be carried out by the bending machine requires the exchange of a jaw part of the first set. Thus also the first storage EV moves in relation to the frame 1 of the working machine so that the jaw part $R_{1m}$ of the first set $R_1$ to be used next comes against the first gripping means 17 of the transfer device 16, which grips said jaw part $R_{1m}$. The jaw parts of the first set can be placed in a row in connection with the first storage EV, whereby the programming logistics required for the exchange becomes simple. The first transfer device 16 comprises a transfer arm 19 which is arranged to be pivotable by actuators (not shown) in the vertical plane in front of the frame 1 around a horizontal shaft 18 fixed in the frame 1, e.g. in a lug 18*a*, said first gripping means 17 being placed at the free end of the transfer arm 19. With particular reference to partial FIG. 7*b*, the locking of the jaw part $R_1n$ of the first set $R_1$ in the location S is simultaneously released by moving at least those jaw parts $R_{2i}$ of the second set $R_2$ which are in the operational position aside in the longitudinal direction of the bending jaws, whereby the locking of the jaw part $R_{1n}$ is released and it can be lifted in the vertical plane in relation to the frame 1 by a movable support device 22, the jaw part $R_{1n}$ being fixed thereto, into a first exchange position VA1. At the same time, the transfer arm 19 of the first transfer device 16 revolves into the low position (clockwise in FIG. 7*b*) in front of the frame 1, i.e. about 180°, the transfer arm 19 pointing substantially downwards. Thus the second gripping means 20 in the first transfer device 16 is placed so that it can grip the jaw part $R_{1n}$ in the first exchange position VA1 in a manner corresponding to that described above in connection with the jaw part $R_{1m}$ (cf. FIG. 14). This step is shown in partial FIG. 7*c*. When both jaw parts $R_{1n}$ and $R_{1m}$ are in connection with the gripping means 17, 20, the transfer arm 19 is turned e.g. about 10° around the shaft 18 (counterclockwise in FIG. 7*d*), whereby the rotary frame 21 provided at the end of the transfer arm 19 and fixed with the gripping means 17, 20, is released to rotate the first and second gripping means 17, 20 and the jaw parts $R_{1n}$ and $R_{1m}$ 180° around the longitudinal axis of the transfer arm 19 by a rotating device 21*a* effective between the transfer arm 19 and the rotary frame 21. Thus a return takes place from the above-mentioned situation of FIG. 7*d* to the situation of FIG. 7*e*, in which the jaw part $R_{1m}$ is in the first exchange position VA1, gripping the support device 22 in the frame 1 of the bending machine. At the same time, a movement takes place in the first storage EV so that the jaw part $R_{1n}$ to be returned there is placed in its position in the first storage EV. In the situation of FIG. 7*f*, the jaw part $R_{1n}$ is returned to the first storage EV and the jaw parts $R_{2i}$ of the second set are pressed against the jaw part of the first set $R_{1m}$, placed by a downwards movement of the support device 22 from the exchange position VA1 into the location S.

FIG. 8 shows an alternative way of carrying out the exchange of the jaw part of the first set $R_{1n} \rightarrow R_{1m}$. The steps presented are substantially similar to those shown in FIG. 7, only with the exception that the jaw parts $R_{1n} \rightarrow R_{1m}$ are exchanged directly at the location S, without any separate step of moving the jaw part from the location S to the exchange position VA1 and vice versa. The location of the exchange position VA1 may correspond to the point to which the jaw part of the first set is moved when narrowing the width in connection with lifting the bending jaws for bringing it away from below the edge bendings.

FIG. 9 shows the exchange of jaw parts of the second set in steps a to 1, as the first embodiment of said exchange. FIG. 9*a* shows the starting point, when the previous bending programme is finished and the next bending programme to be carried out by the bending machine requires the exchange of the operational jaw parts $R_{2i}$ of the second set with the particular purpose of moving the edge pieces $RK_1$, $RK_2$ to a new position for adjusting the total width. Thus, in the first step, the jaw part $R_{1n}$ of the first set is released from the locking and transferred into the exchange position VA1 (for a possible exchange carried out simultaneously, as shown in FIG. 7) and the jaw parts $R_{2i}$ of the second set are moved in opposite directions in the longitudinal direction of the bending jaws, whereby they are placed in the exchange position VA1. As shown particularly in FIG. 9*a*, there is a jaw part series $PL_{M1}$ at both sides of the bending machine, at both ends of the bending jaws, the width of the series corresponding to or exceeding the width $C_K$ of the edge piece ($RK_1$, $RK_2$). These jaw part series $PL_{M1}$ are in connection with the second transfer device 30. In this embodiment, the second storage $TV_1$, $TV_2$ is partly placed in connection with the transfer device 30, whereby the part REI1 of the non-functional ET jaw parts of the second set form extensions to the edge pieces $RK_1$, $RK_2$ at the outer edges of the bending jaws (cf. FIG. 4).

Figure 9A:
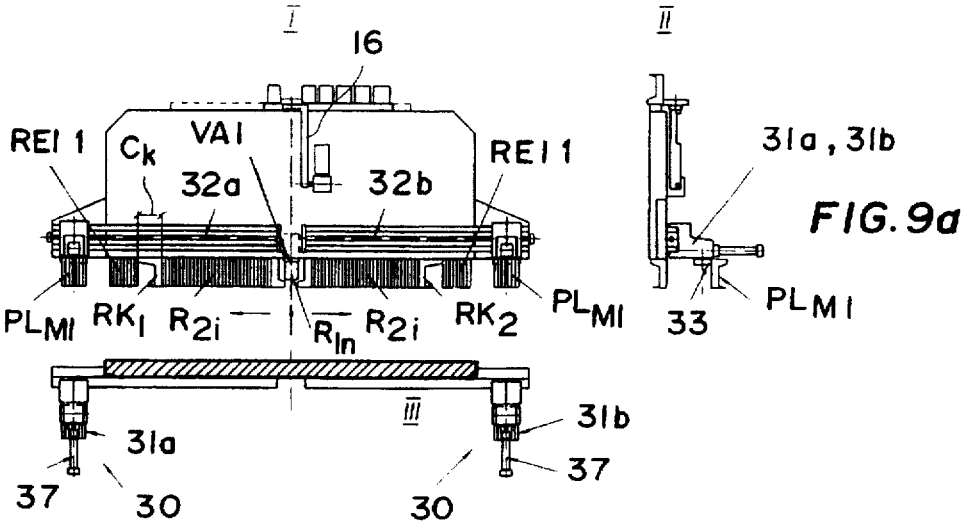
FIG. 9 shows the exchange of the jaw parts of the second set, its first embodiment in steps a to 1, whereby the series I and II correspond to the direction of the previous FIGS. 7 and 8 and the series III shows the corresponding situation seen from above.
Figure 9B:
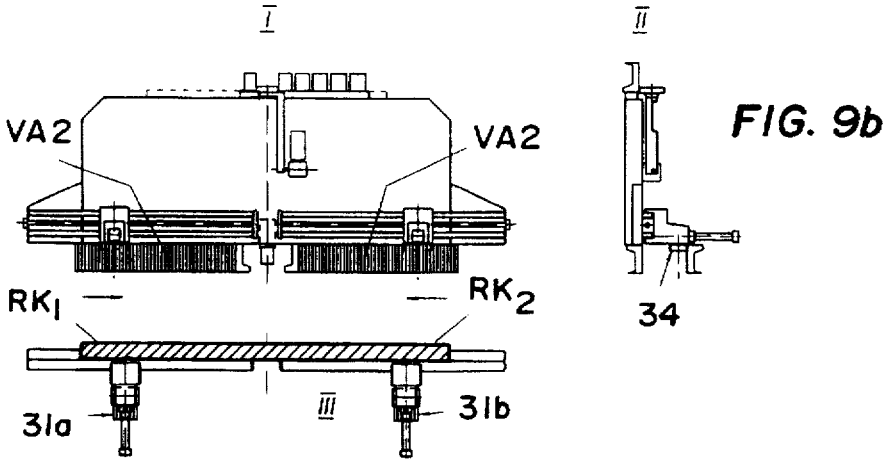
Figure 9C:
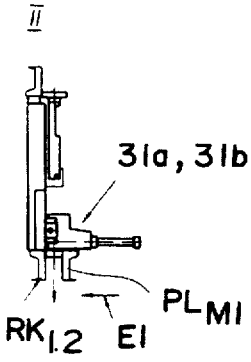
Figure 9D:
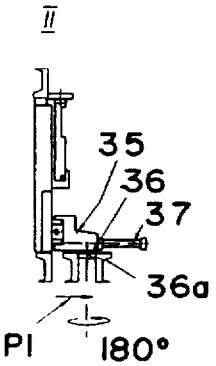

The second transfer device 30 comprises two transfer units 31*a*, 31*b* placed in horizontal conduits 32*a*, 32*b* of the bending jaws in the longitudinal direction in the frame 1 of the bending machine, these being placed at both sides of the first transfer device 16 in front of the frame 1 and above the bending jaws. The jaw part series $PL_{M1}$ formed by jaw parts of the second set are both supported by the first gripping means 33 in the transfer units 31*a*, 31*b*. As shown in FIG. 9*b*, the transfer units are moved against the edge pieces $RK_1$, $RK_2$ in the horizontal conduits 32*a*, 32*b*. As shown particularly in FIG. 9*c*, after releasing the lockings (to be described below), the second gripping means 34 of both transfer units 31*a*, 31*b* grip the edge pieces $RK_1$, $RK_2$ respectively, whereby particularly in connection with the gripping movement of the gripping means (arrow E1 in FIG. 9*c*), at least part of the locking of the edge pieces $RK_1$, $RK_2$ is released along the horizontal conduit 37. After this, the frame 35 of the transfer unit is moved, supported by the horizontal conduit 37 therein, whose longitudinal direction is perpendicular to the longitudinal direction of the bending jaws, away from the bending jaws (arrow P1 in FIG. 9*d*), whereby a rotating device 36*a*, placed in connection with the transfer units 31*a*, 31*b* and effective between the frame 35 of the transfer unit and the rotational frame 36, is used for revolving the rotational frame 36, with the first and second gripping means 33, 34 placed therein, 180° around the vertical direction. Thus said jaw part series $PL_{M1}$ is placed in the opening left by the respective edge piece $RK_1$, $RK_2$.

Figure 9E:
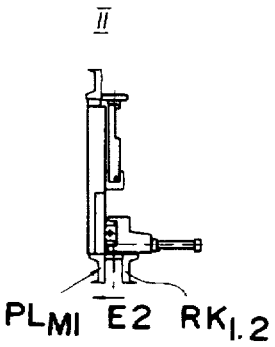
Figure 9F:
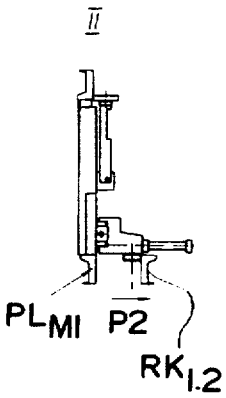
Figure 9G:
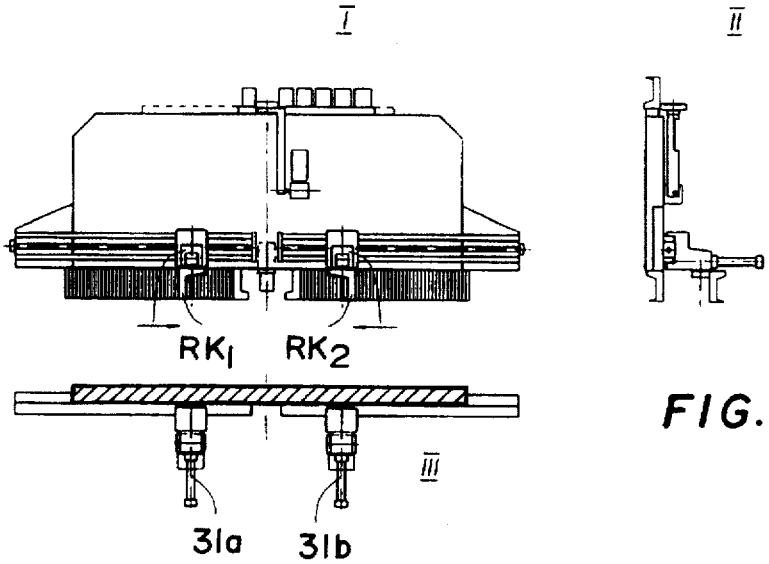
Figure 9H:
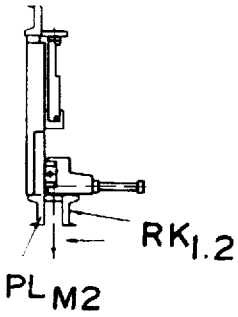
Figure 9I:
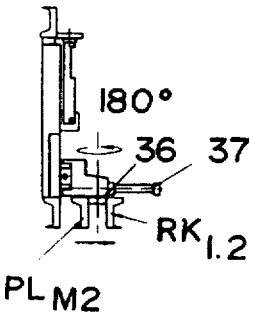
Figure 9J:
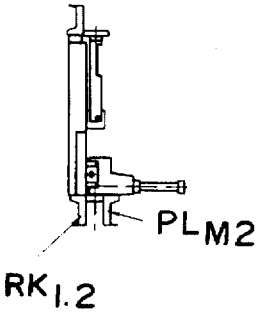
Figure 9K:
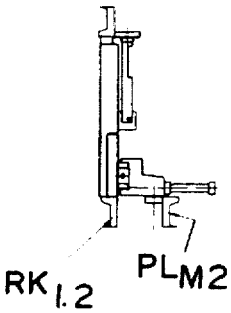
Figure 9L:
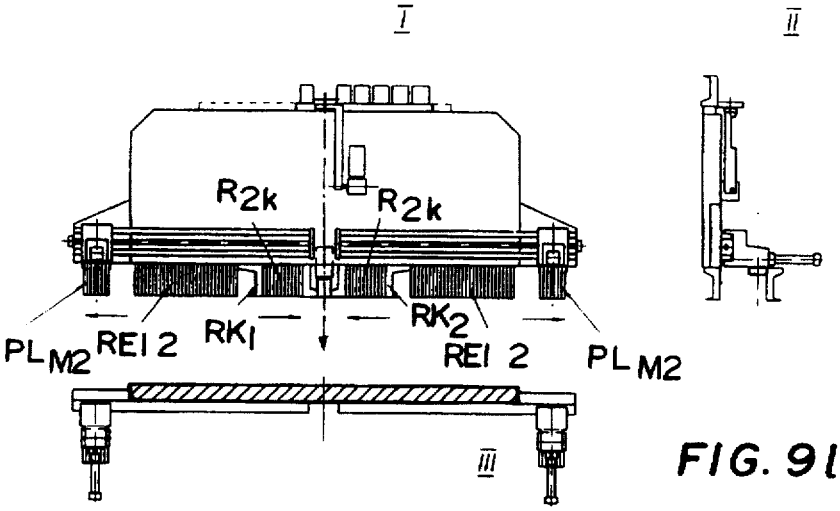
Figure 10A:
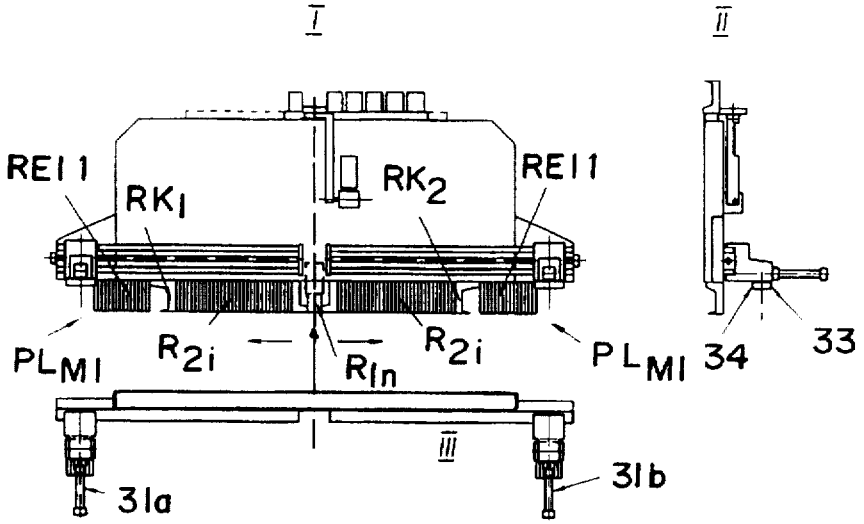
FIG. 10 shows the exchange of the jaw parts of the second set in a second embodiment also as steps a to 1 and series I, II and III.
Figure 10B:
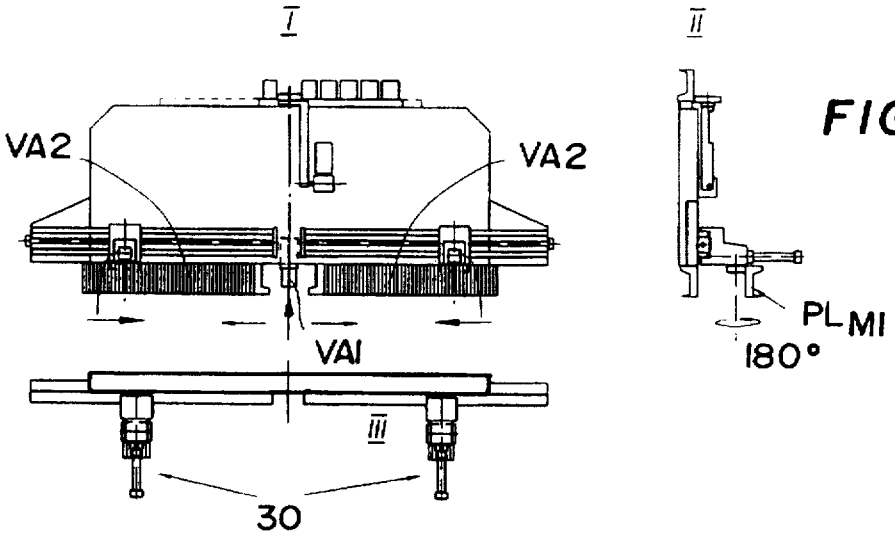
Figure 10C:
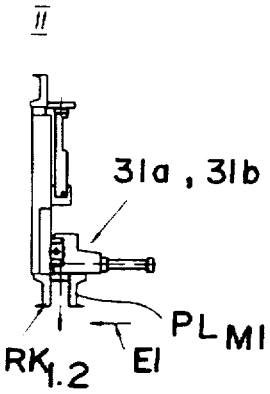
Figure 10D:
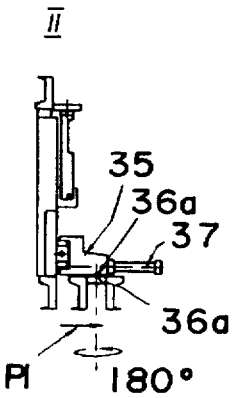
Figure 10E:
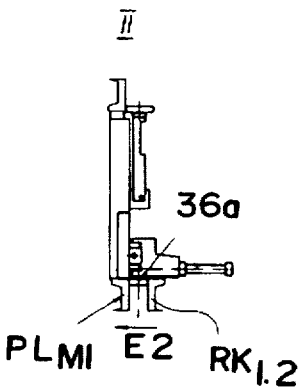
Figure 10F:
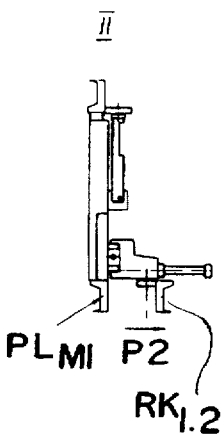
Figure 10G:
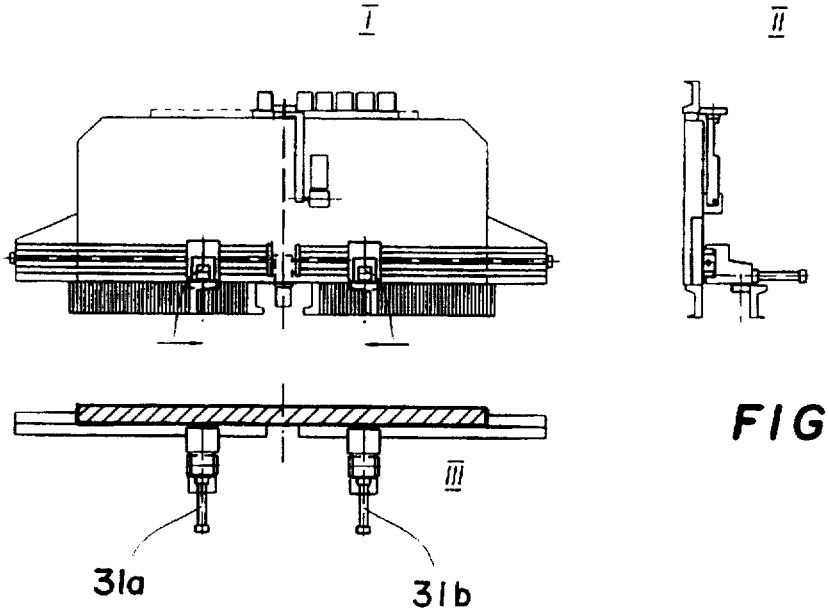
Figure 10H:
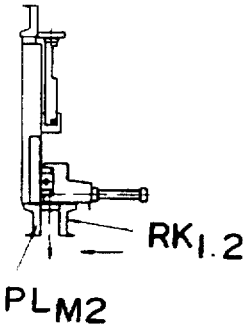
Figure 10I:
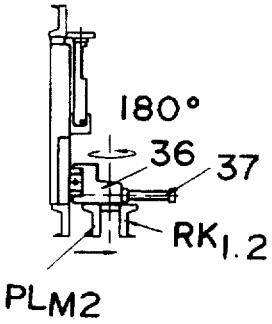
Figure 10J:
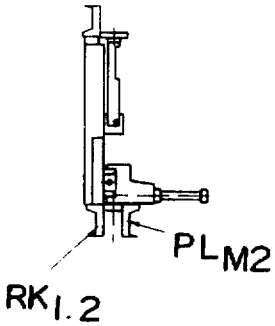
Figure 10K:
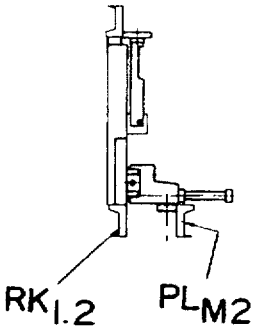
Figure 10L:
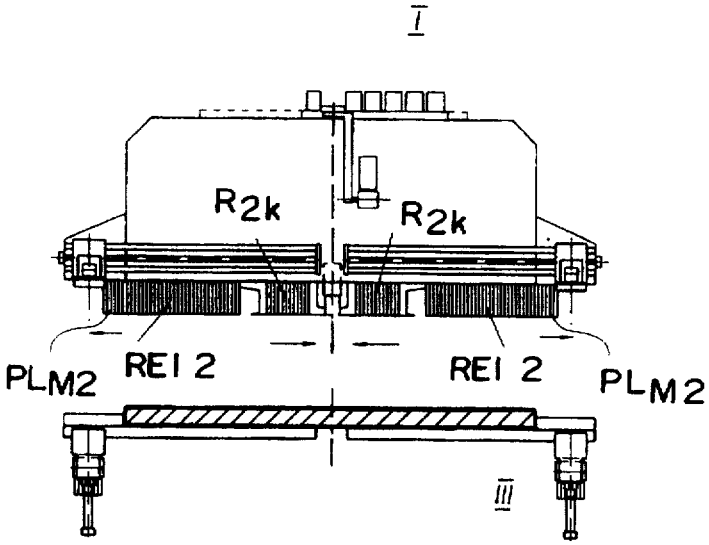
Figure 11A:
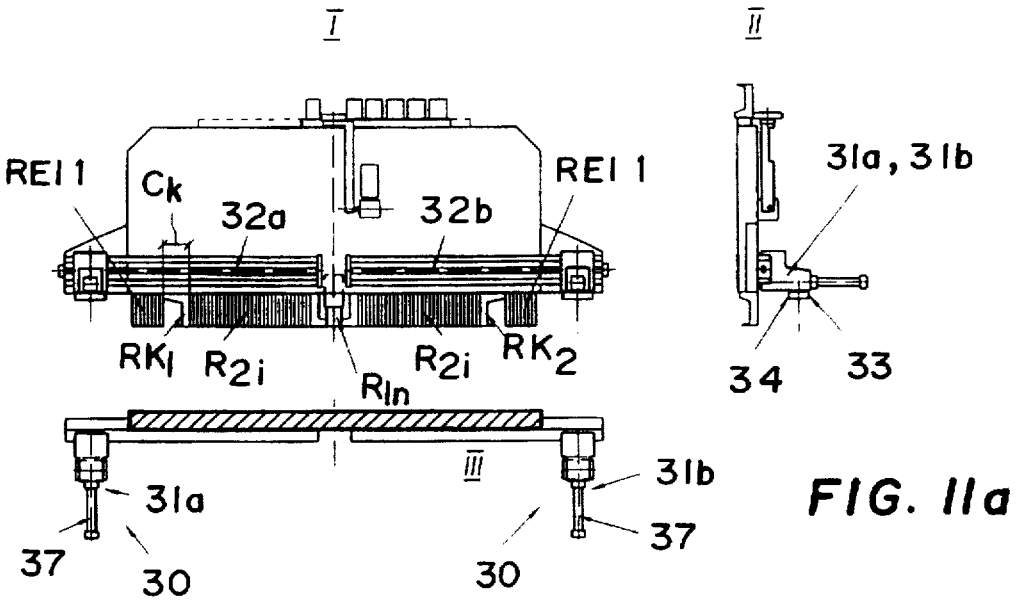
FIG. 11 shows the exchange of the jaw parts of the second set in a third embodiment as steps a to n and series I, II and III.
Figure 11B:
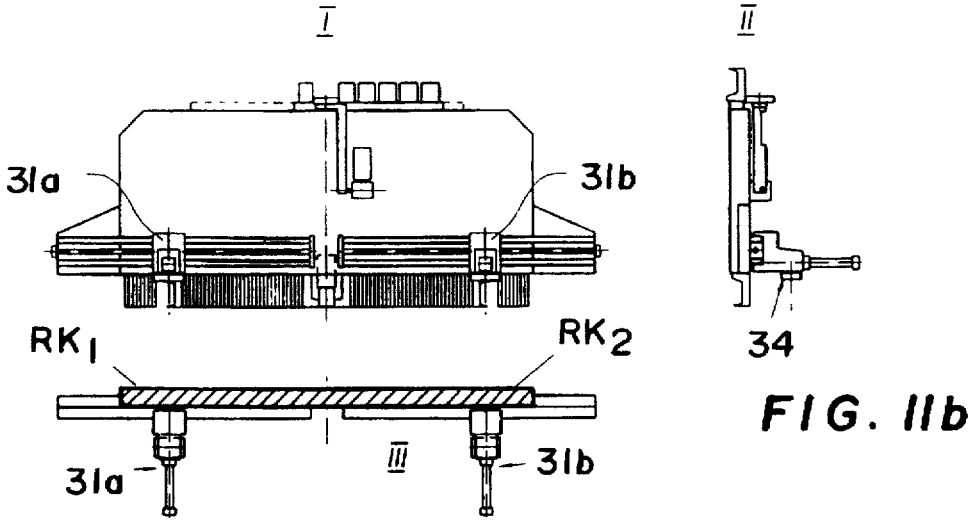
Figure 11C:
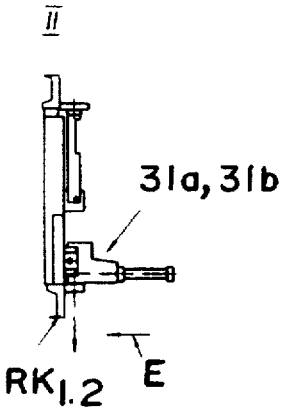
Figure 11D:
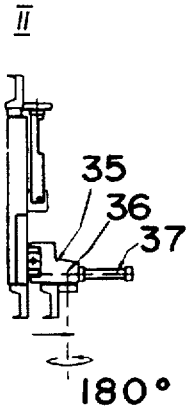
Figure 11E:
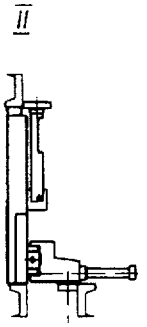
Figure 12A:
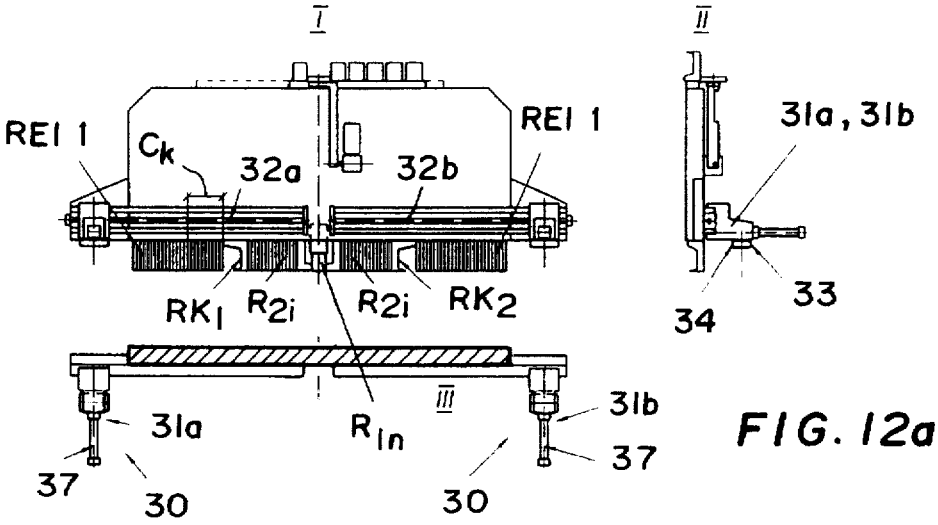
FIG. 12 shows the exchange of the jaw parts of the second set in a fourth embodiment as steps a to o and series I, II and III.
Figure 12B:
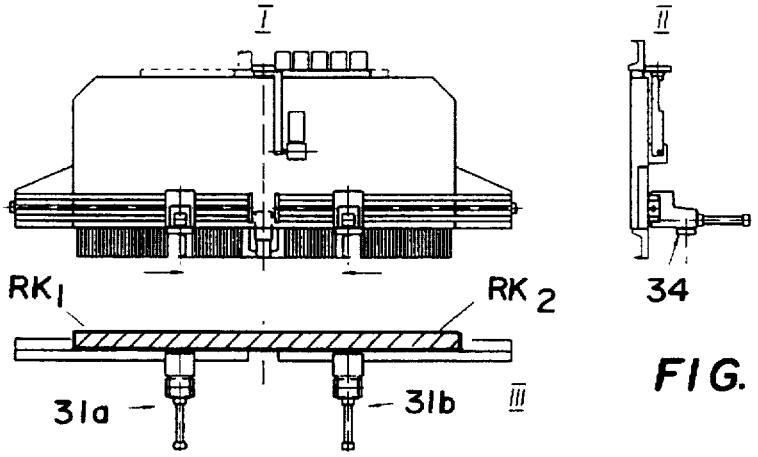
Figure 12C:
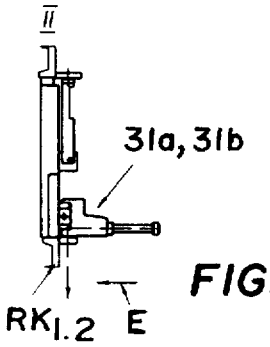
Figure 12D:
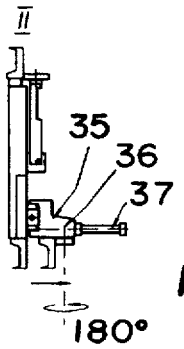
Figure 12E:
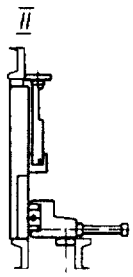
Figure 12F:
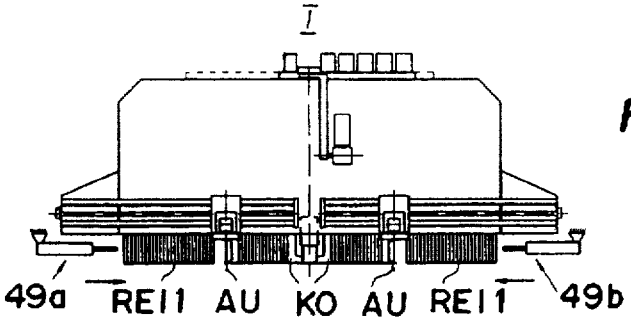

According to FIG. 9e, the transfer unit 31a, 31b moves next the edge piece $RK_1$, $RK_2$ of the jaw part series $PL_{M1}$ to the previous location (arrow E2 in FIG. 9e). According to FIG. 9f, the transfer units 31a, 31b are moved along the horizontal conduit 37 away from the bending jaws, supporting the edge piece $RK_1$, $RK_2$ (arrow P2 in FIG. 9f). Further, both transfer units 31a, 31b are moved, as shown in FIG. 9g, to a new location of the edge pieces $RK_1$, $RK_2$, and the steps shown in FIGS. 9h–k are carried out, substantially corresponding to the removal of the edge piece $RK_1$, $RK_2$ described above, with the exception of removing now the jaw part series $PL_{M2}$, whose width corresponds to at least the width of the edge piece $RK_1$, $RK_2$, from said position. Thus, after revolution of the rotating frame 36 by the transfer units 31a, 31b in the outer position, the edge pieces $RK_1$, $RK_2$ can be placed in position, as shown in FIG. 9j, and the transfer units 31a, 31b can be transferred along the horizontal conduits to the ends of the bending jaws. After returning the jaw part $R_{1n}$ of the first set to the location S, moving the transfer units 31a, 31b along the horizontal conduits 32a, 32b to the second storage $TV_1$, $TV_2$, and clamping the jaw parts $R_{2k}$ of the second set according to the new adjustment, the bending programme can be carried out further according to FIG. 9l. Consequently, the number of non-operational jaw parts of the second set as extensions of the edge pieces $RK_1$, $RK_2$ is changed REI1→REI2 and the number of operational jaw parts of the second set $R_{2i}$→$R_{2k}$ (FIG. 9a–FIG. 9l). The clamping of the bending jaws in its longitudinal direction is carried out by directing the compression to the outermost jaw part of the non-operational jaw parts REI2 of the second set (cf. FIG. 13).

FIG. 10 shows another embodiment of exchanging the jaw parts $R_{2i}$ of the second set. Thus the transfer units 31a, 31b are empty, the bending jaws carrying out bending. All the non-operational jaw parts REI1 of the second set are placed at the side of the edge pieces $RK_1$, $RK_2$, as extensions of the same. Thus, upon beginning the exchange, after the necessary releasing of lockings and moving of the jaw parts of the second set, the transfer units 31a, 31b in the exchange position VA2 receive the jaw part series $PL_{M1}$ from the non-operational jaw parts REI1 into the first gripping means. After a 180° revolution of the rotational frame 36, the transfer units 31a, 31b are moved against the edge pieces $RK_1$, $RK_2$, whereby the exchange is carried out as described in connection with FIG. 9 and shown in FIGS. 10c–f, the jaw part series $PL_{M1}$ remaining at the locations of the removed edge pieces $RK_1$, $RK_2$. The edge pieces $RK_1$, $RK_2$ are then placed in a new position as described in connection with FIG. 9 and shown in FIGS. 9g–k. Finally, the transfer units 31a, 31b are moved at the ends of the bending jaws, the jaw part series $PL_{M2}$ are placed as extensions of the bending jaws, and the bending jaws is clamped. The second storage $TV_1$, $TV_2$ is thus the same as the location REI2 of the non-operational jaws parts of the second set. This solution gives the advantage that all jaw parts of the second set are clamped in connection with the bending jaws. The reference numerals and other markings in FIG. 10 correspond to those in FIG. 9.

FIG. 11 shows, in steps a to n, a third embodiment of exchanging the jaw parts of the second set, particularly for use in connection with reducing the operational width. The transfer units 31a, 31b are empty at the beginning, and they are moved against the edge pieces $RK_1$, $RK_2$, respectively; the respective edge pieces are then removed from their previous locations by steps shown in FIGS. 11a–e, whereby openings AU are formed. The transfer units 31a, 31b are moved in the new locations of the edge pieces $RK_1$, $RK_2$, respectively (FIG. 11f), and the jaw part series $PL_{M1}$ at the respective location is gripped and replaced by the edge piece $RK_1$, $RK_2$ by steps shown in FIGS. 11g–j. After this, by steps shown in FIGS. 11k–n, said jaw part series $PL_{M1}$ is moved to the respective end of the bending jaws to form an extension to the operational part of the bending jaws, and the jaw parts are moved towards the center and the bending jaws are clamped in their longitudinal direction, whereby the opening AU formed in the step of FIG. 11f is filled in. It should be noted that the embodiment of FIG. 11 is bas ed on the fact that the jaw parts in the operational position T (FIG. 4) are not moved to any particular exchange position (VA1, VA2) according to FIGS. 9 and 10 but the longitudinal locking of the bending jaws is released at the beginning (cf. FIG. 13).

FIG. 12 shows, in steps a to o, a fourth embodiment of exchanging jaw parts of the second set, particularly in connection with increasing the operational width. The basic idea is substantially the same as that shown in FIG. 11, with the exception that at the step shown in FIG. 9f, actuators 49a, 49b (described more closely in connection with FIG. 13) are used for moving the jaw parts of the second set, which at the preceding stage were in the non-operational position in the second storage $TV_1$, $TV_2$ (sets REI1), towards the center part KO for filling in the opening AU left by the edge pieces $RK_1$, $RK_2$ by the steps shown in FIGS. 12a–e. The steps shown in FIGS. 12g–o correspond to those shown in FIGS. 11f–n.

Consequently, the embodiments of FIGS. 11 and 12 are characterized by not carrying out transfers to the exchange positions (VA1 and VA2). This is particularly advantageous when jaw parts of only the second set are exchanged, whereby an exchange of the jaw part of the first set, which is possible simultaneously, is not carried out. The locking in the longitudinal direction and the transfers of the jaw parts of the second set are carried out by the actuators 49a and 49b.

Figure 13:
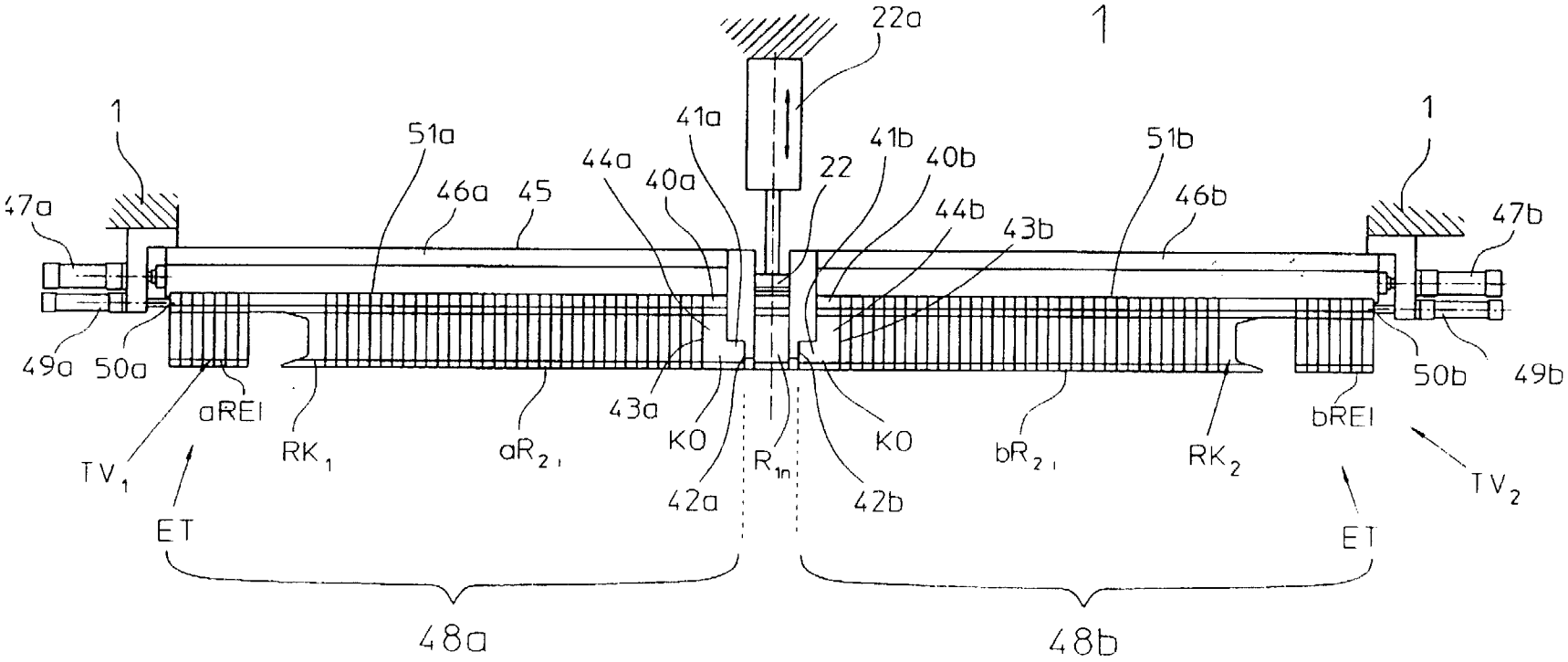
FIG. 13 shows the special structures of the bending jaws for carrying out clamping and transfer operations in a schematic view seen in a direction perpendicular to the longitudinal direction of the bending jaws.

With reference to FIG. 13 showing the special structures of the bending jaws for carrying out clamping operations in a schematic view seen in a direction perpendicular to the longitudinal direction of the bending jaws, it can be stated that the jaw part $R_{1n}$ elected from the first set $R_1$ is arranged to be placed in a central part KO. The central part KO consists mainly of two locking pieces 40a, 40b preferably with an L form when seen in the direction perpendicular to the longitudinal axis of the bending jaws. The locking pieces are placed against each other so that the jaw part $R_{1n}$ selected from the first set is placed between the end faces 42a, 42b of the base parts 41a, 41b of the L forms placed against each other. Thus the back surfaces 43a, 43b of the vertical parts 44a, 44b of the L forms extend towards the jaw parts $aR_{2i}$, $bR_{2i}$ of the second set, being supported by said jaw parts and/or the edge pieces $RK_1$, $RK_2$. The bending jaws are supported in relation to the frame 1 of the bending machine against the conduits 45 in the longitudinal direction of the bending jaws. The frame part 46a, 46b of the bending jaws consists of two parts. In connection with each frame part 46a, 46b and between the bending frame 1, actuators 47a, 47b are provided for moving the two bending jaw parts 48a, 48b thus formed in relation with the frame 1 in the longitudinal direction of the bending jaws either towards the edge part $R_{1n}$ selected from the first set or in opposite directions away from it. Thus each bending jaw part 48a, 48b consists firstly of one locking piece (either 48a or 48b) of the central part KO, secondly of half of the jaw parts of the second set $R_2$ (i.e. either the combination $aR_{2i}$ and aREI or $bR_{2i}$ and bREI), and thirdly of one edge piece (either $RK_1$ or $RK_2$).

The actuators 47a, 47b are arranged to carry out a movement in the longitudinal direction of the bending jaws. The actuators 47a, 47b can be cylinder-piston-arrangements driven by a pressurized medium, whereby the piston is fixed to the frame part 46a, 46b and the cylinder preferably to the frame 1. The length of movement of the actuators 47a, 47b in the longitudinal direction of the bending jaws is elected so that, firstly, the bending jaws can be placed in the exchange position VA2 of the jaw parts of the second set; and secondly, the length of movement is sufficient for clamping the jaw part, particularly the narrowest jaw part, of the first set that is to be placed in connection with the central part KO between the end faces 42a, 42b of the locking pieces and further for bringing the end faces 42a, 42b substantially against each other for the purpose of narrowing the blade width temporarily when removing the bending jaws upwards between the edge bendings of the sheet. Particularly the exchange position VA2 for jaw parts of the second set is arranged so that the widest jaw part of the first set $R_1$ can be placed between the end faces 42a, 42b of the locking parts 40a, 40b, the jaw parts of the second set being placed in the exchange position VA2. In connection with the support device 22, there is an actuator 22a for moving the jaw part $R_{1n}$ of the first set in the vertical direction. The actuator 22a is a cylinder-piston arrangement driven by a pressurized medium, the piston being fixed to the support device 22 and the cylinder to the frame 1.

The locking parts 40a, 40b of the central part KO are fixed at the top of the vertical parts 44a, 44b to the frame parts 46a, 46b of the bending jaws, respectively, against opposite ends of said frame parts. The locking parts 40a, 40b are directed downwards at the ends of the frame parts, from the bottom surface thereof, so that the end surfaces 42a, 42b at the lower part thereof are directed against each other.

The locking parts 40a, 40b in connection with the central part KO can, as distinct from the L form shown in FIG. 13, also be e.g. rectangular, whereby the vertical end and back surfaces of the same are also substantially equal in size. Also other cross-sectional forms are feasible.

Further, the bending jaw parts 48a, 48b comprise each an actuator 49a, 49b. The purpose of these actuators is to lock the combination, which is in connection with the respective frame part 46a, 46b and comprises firstly the operational jaw parts of the second set (either $aR_{2i}$ or $bR_{2i}$), secondly one edge piece (either $RK_1$ or $RK_2$), and thirdly the non-operational jaw parts of the second set (either aREI or bREI) placed outside the edge pieces as extensions of them, by a compressing effect directed by the actuators 49a, 49b between the buffer 50a, 50b of the respective actuator 49a, 49b and the back surfaces 42a, 42b of the locking pieces 40a, 40b. For the purpose of moving and locking the bending jaws in the longitudinal direction as described above, both frame parts 46a, 46b of the bending jaws are provided with a conduit 51a, 51b, e.g. a protruding part, arranged on the bottom surface of the respective frame part 46a, 46b in the longitudinal direction of said frame part. Both the jaw parts of the second set and the edge pieces are provided with a counterpart, e.g. a grooving, placed in said conduit 51a, 51b. Also, between the conduits 51a, 51b and their counterparts, lockings are provided, as will be described below in connection with FIGS. 15 and 16, on one hand for arresting the jaw parts $R_2$ of the second set and the edge pieces $RK_1$, $RK_2$ in connection with the respective bending jaw part 48a, 48b and on the other hand for locking them in connection with said bending jaw part 48a, 48b.

Figure 14:
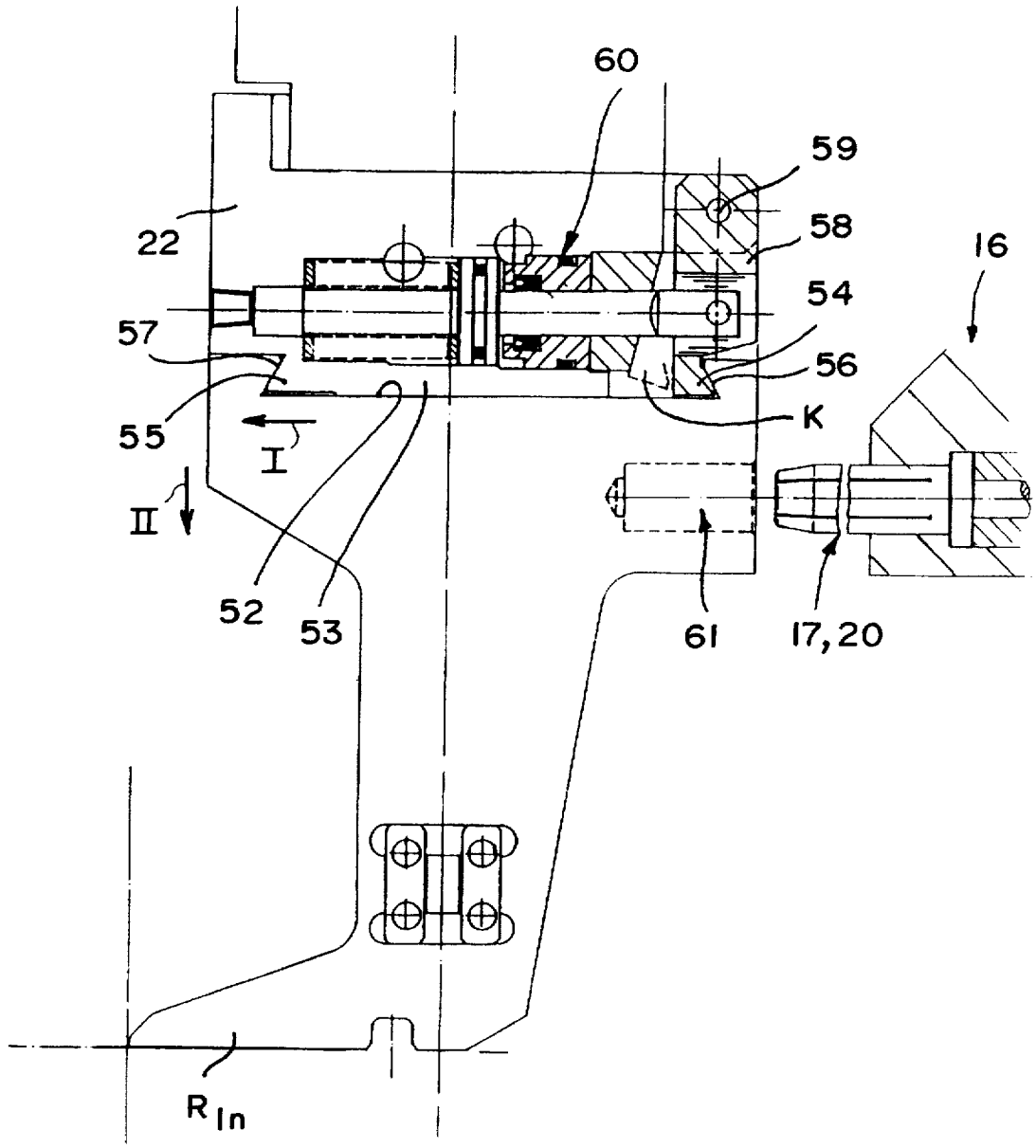
FIG. 14 shows the fastening and detaching of the jaw part of the first set in connection with the bending jaws, seen in a direction perpendicular to the longitudinal direction of the bending jaws.

With reference to FIG. 14, the jaw part $R_{1n}$ of the first set is fixed to the support device 22, arranged in the above-described manner to be movable in the vertical direction by the actuator 22a (FIG. 13).

The jaw part $R_{1n}$ is provided with a dovetail groove 52 in the longitudinal direction of the bending jaws, and the support device 22 with a dovetail projection 53 in a corresponding manner. In connection with the support device 22, there is a locking piece 58 arranged to be movable in relation to the support device 22, the end part of the locking piece 58 forming a first apex 54 of the dovetail projection 53 and the second apex 55 being stationary in relation to the support device 22. The oblique apices 54 and 55 are placed in oblique recesses 56, 57 at the edges of the dovetail groove 52.

The locking piece 58 is articulated with a joint 59 to be pivotable in the vertical plane in connection with the support device 22. Further, the locking piece 58 is connected at its center to a locking actuator 60, whose structure corresponds substantially to that shown in FIG. 15 and to be described further below. The locking actuator 60 is placed inside the support device, and it is driven by a pressurized medium.

Figure 15:
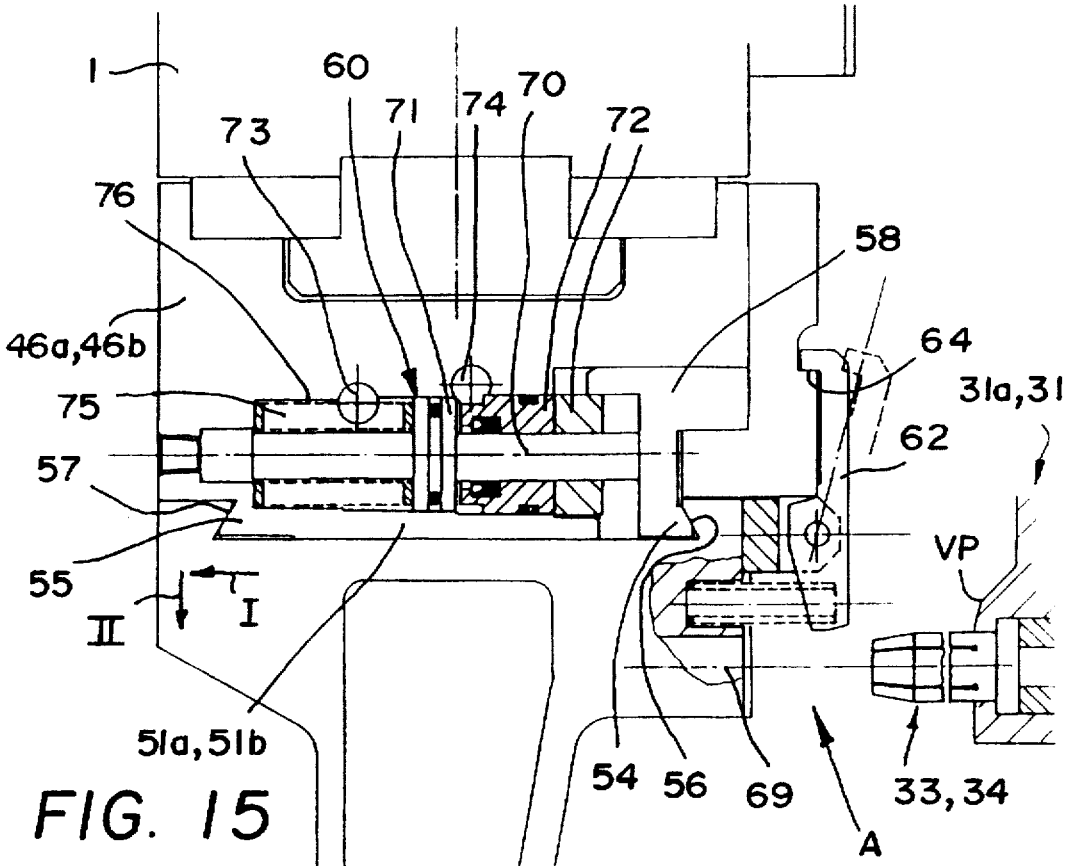
FIG. 15 shows the structure of a jaw of the second set and also its fastening and detaching, seen in a direction perpendicular to the longitudinal direction of the bending jaws.
Figure 16:
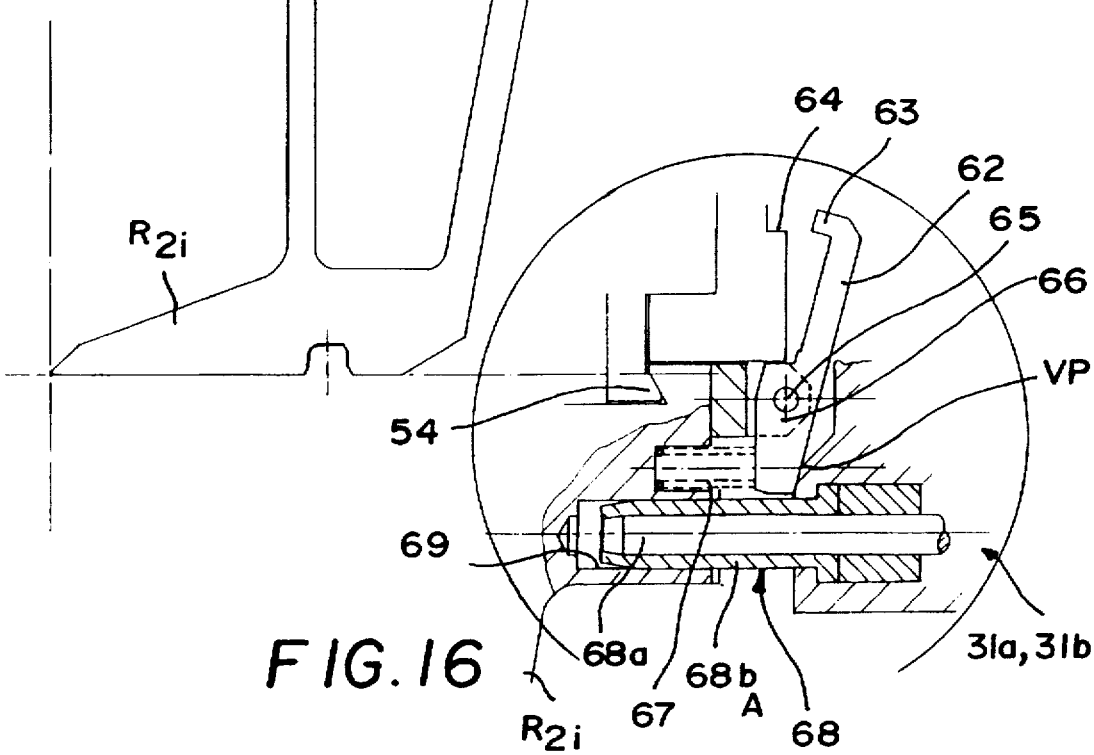
FIG. 16 shows a partially enlarged view A of FIG. 14 in a locking situation.

The gripping means 17, 20 (FIGS. 7 and 8), placed in connection with the first transfer device 16, correspond in their structure to those shown in FIGS. 15 and 16, whereby these are provided preferably two means side by side. Their counterpart, such as a pair of adjacent holes, is placed at a location 61, corresponding in structure to the counterpart 69 shown in FIGS. 15 and 16.

The jaw part $R_1n$ of the first set is released substantially in the same way as shown in FIGS. 15 and 16, whereby the first apex 54 is moved by the gripping means 17 (or 20) from the locking position to the point K shown by broken lines, preferably when coupled with the counterpart at the point 61 or by a locking actuator 60 separate from said coupling. Thus the jaw part $R_{1n}$, partly supported by the first transfer device 16, is first moved horizontally to the left in FIG. 14 (arrow I) for releasing the vertical locking between the parts 55 and 57, whereby the first apex, having moved to the point K, does not prevent this movement, and after this downwards in FIG. 14 (arrow II), whereby the jaw part $R_1n$ is released to be moved to the right in FIG. 14, from behind the apex 55. The gripping means 17, 20 of the transfer device 16 can be equipped with protruding means or the like, which, upon coupling said gripping means 17, 20 and the jaw part $R_{1n}$ (cf. FIG. 16), release the first apex 54 from the groove 56 to the position K.

FIGS. 15 and 16 show the locking of jaw parts $R_2$ of the second set and the method of releasing it, primarily the locking and releasing of the jaw part series indicated above with the reference letters $PL_M$, $PL_{M1}$ and $PL_{M2}$ as well as of the edge pieces $RK_1$, $RK_2$, carried out by the second transfer device 30 (transfer units 31a, 31b and the adjacent gripping means 33, 34 in connection with the same).

The conduits 51a, 51b in connection with the frame parts 46a, 46b correspond in their cross-section and general construction to that described in connection with FIG. 14, and the corresponding elements are indicated with reference numerals corresponding to those in FIG. 14.

The locking piece 58 is substantially a moulding piece of equal length with the frame parts 46a, 46b, equipped with locking actuators 60 at certain intervals in the longitudinal direction of the bending jaws. In the present embodiment, the locking piece 58 is moved by the joint effect of the locking actuators 60 driven by a pressurized medium to the left in FIG. 15, opening the locking between the apex 54 and the recess 56. This takes place after the gripping means 33, 34 has moved to the position shown in FIG. 16, in connection with the jaw part $R_{2i}$. The gripping means has an interface VP that releases the vertical locking of a rocking arm 62 in the jaw part $R_{1n}$, i.e. removes a locking stud 63 at the first end 62*a* of said rocking arm from a horizontal groove 64 in connection with the frame parts 46*a*, 46*b* above the jaw part. The rocking arm 62 is articulated with a joint 65 to a stud 66 in the jaw part $R_{2i}$. At the other end of the rocking arm 62, there is a spring means 67 coupled with the jaw part $R_{2i}$ that returns the rocking arm 62 to the locking position upon removal of the gripping means 33, 34 from the connection of the jaw part $R_{2i}$ when the jaw part $R_{2i}$ is removed from said transfer unit 31*a*, 31*b*.

In the present embodiment, the gripping means 33, 34 is a so-called expanding mandrel 68 with an outer bush 68*a* with longitudinal grooves, a pin part 68*b* being arranged to be movable inside the outer bush 68 in its longitudinal direction. The jaw part $R_{2i}$, on the other hand, is provided with a hole 69 functioning as a receiving means. The pin part 68*b* being inside the outer bush 68*a* in its front position shown in FIG. 16, a friction joint is formed between the outer surface of the radially expanding bush 68*a* and the inner surface of the hole 69, coupling the jaw part $R_{2i}$ and the transfer unit 31*a*, 31*b* together and coming loose when the pin part 68*b* is substantially outside the bush 68*a*.

The locking actuator 60 comprises a piston rod 70 and a piston 71. The piston rod 70 penetrates a sealing part 72 and is coupled with the locking piece 58. The frame parts 46*a*, 46*b* are provided with longitudinal boreholes 73 and 74 which are connected at opposite sides of the piston 71 for feeding pressurized medium to the cylinder space 75 for moving the piston 71 in the cylinder space 75 and thus for moving the locking piece 58. As shown in FIG. 15, the locking of the locking piece 58 is secured by a pressure spring 76, whereby pressure disturbances do not release the locking between the parts 54 and 56.

It should be noted that there is a sufficient number of gripping means 33, 34 side by side at certain intervals in connection with the transfer units 31*a*, 31*b*, whereby it is possible simultaneously to grip and release as well as to install and lock the said jaw part series $PL_M$, $PL_{M1}$, $PL_{M2}$. In connection with exchanging the edge pieces $RK_1$, $RK_2$, two or more of these gripping means are used, whereby the edge pieces are equipped with counterparts for the holes 69.

With reference to the description above, e.g. the exchange of the jaw part series $PL_M$ is carried out so that firstly a) a series of gripping means 33, 34, are placed side by side in the transfer unit 31*a*, 31*b* in connection with the counterparts 69 of the adjacent jaw parts $R_{2i}$, i.e. the jaw part series $PL_M$, $PL_{M1}$, $PL_{M2}$, b) the gripping means 33, 34 and said counterparts 69 are locked e.g. by means of a radially expanding mandrel 68, c) the safety locking between the jaw part series $PL_M$, $PL_{M1}$, $PL_{M2}$ and the frame parts 46*a*, 46*b* is released, particularly upon placing the gripping means 33, 34 in connection with the counterparts 69, preferably by releasing the locking arm 62 from the groove 64 of the frame parts 46*a*, 46*b*, d) the locking of conduits 51*a*, 51*b* and 52 in the frame parts 46*a*, 46*b* on one hand and in the jaw part series $PL_M$, $PL_{M1}$, $P_{M2}$ on the other hand is released, preferably by moving the movable locking piece 58 of the conduits 51*a*, 51*b* in relation to the frame parts 46*a*, 46*b*, for releasing the first locking of the first part 54, 56 substantially in the vertical and horizontal directions, e) said jaw part series $PL_M$, $PL_{M1}$, $PL_{M2}$ is moved by said transfer unit 31*a*, 31*b* in a first direction, particularly in the horizontal direction (arrow I), and then in a second direction, particularly in the vertical direction (arrow II) downwards for releasing the second locking of the second part 55, 56 substantially in the vertical and horizontal directions, and f) after the steps a to e, the exchange steps described above in connection with FIGS. 9–12 are carried out.

It should be noted that the steps a to f described above are substantially applicable also for the exchange of the edge pieces $RK_1$, $RK_2$.

We claim:

1. Method of adjusting width of bending jaws of a bending machine including two sets of bending jaws transferable and/or exchangeable from an operational region to a non-operational region, comprising the steps of:

placing a first set of said two sets of bending jaws at proximate middle of said operational region;

placing a second set of said two sets of bending jaws at both sides of the bending jaws of said first set;

providing respective edge pieces to each end of the bending jaws at said operational region for defining a total width of the bending jaws;

calculating the total width of the bending jaws by electing from said first set which includes a group of jaw parts of different widths at least one jaw part for placement at said operational region of the bending jaws, electing a group of jaw parts with identical width and separate from said edge pieces to form said second set, and calculating the width of the bending jaws required according to the equation $$L=R_{1n}+N*R_{2i}+C$$

where

L=the width of the bending jaws, $R_{1n}$=the width of the jaw part (n=0 . . . M) elected from said first set, N=the width of the jaw parts of said second set, i.e. a constant, $R_{2i}$=the number (i=0 . . . k) of jaw parts of said second set at the operational region of the bending jaws, and C=a constant representative of the parts with a constant width included in the total width of the bending jaws.

2. Method according to claim 1, wherein the number of jaw parts in said second set is chosen to be even; and wherein the same number of said second set are placed on both sides of the jaw part chosen from said first set to achieve a symmetrical bending jaw structure, where the index i in the term $R_{2i}$ is i=0, 2, 4, 6 . . . k, where k is an even number.

3. Method according to claim 1, wherein the number of jaw parts in said first set is chosen according to the following formula:

$$M=\frac{N}{LE} \text{ or}$$

$$M=\frac{2*N}{LE}$$

where

M=number of jaw parts in said first set,

N or 2*N=width of each jaw part or two jaw parts in said second set, and

LE=constant difference in the width of subsequent jaw parts, e.g. $R_{1,n}$ and $R_{1,n+1}$, in a series of jaw parts of said first set.

4. Method according to claim 1, wherein the width of the jaw parts of said first set is elected according to the formula $$KL_n = C_M + K_{(k)} * LE$$

where $KL_n$=width of a certain jaw part $R_{1,n}$ of said first set, where n is a value 1 . . . M, and where M is the number of jaw parts, $C_M$=a constant, i.e. the basic width of jaw parts in said first set, $K_{(k)}$=a coefficient with a value 0, 1, 2, up to M−1, where M is the number of jaw parts, and LE=constant difference in the width of subsequent jaw parts, e.g. $R_{1,n}$ and $R_{1,n+1}$, in a series of jaw parts of the first set; and wherein said constant $C_M$ is elected to temporarily narrow the width of the bending jaws.

5. Method according to claim 1, further comprising the steps of:

placing a first storage for jaw parts of said first set relative to said bending machine; and placing relative to said bending machine a first transfer device substantially between said first storage and the at least one jaw part of said first set at said operational region.

6. Method according to claim 1, wherein for changing the at least one jaw part of said first set, further comprising the steps of:

releasing the at least one jaw part of said first set locked at a location in the longitudinal direction of said operational region;

using a transfer device for retrieving a replacement jaw part of said first set from a first storage and placing said replacement jaw part next to said location;

using said transfer device for gripping said jaw part to be removed from said location;

placing said to be removed jaw part to a support;

using said transfer device to effect an exchange movement for reversing the respective placements of said to be removed jaw part and said replacement jaw part;

locking into said location said replacement jaw part of said first set relative to the bending jaws; and moving said to be removed jaw part to said first storage.

7. Method according to claim 1, wherein for changing a jaw part of said first set, further comprising the steps of:

releasing the jaw part of said first set locked at a location in the longitudinal direction of said operational region;

transferring the to be removed jaw part from said location to an exchange position;

using a transfer device for grabbing a replacement jaw part in a first storage and placing it next to said location;

using said transfer device for grabbing said to be removed jaw part from said exchange position and removed from the location and releasing it to a support of said transfer device;

carrying out an exchange movement via said transfer device to reverse the respective positions of said to be removed jaw part and said replacement part;

transferring said replacement jaw part to said location and locking said replacement jaw part in place relative to said bending jaws;

locking said replacement jaw part in the longitudinal direction of the bending jaws; and transferring said to be removed jaw part to said first storage.

8. Method according to claim 1, wherein for exchanging said jaw parts of said second set at said operational region, further comprising the steps of:

releasing at least those jaw parts of said second set locked at said operational region in the longitudinal direction of the bending jaws;

releasing and transferring said edge pieces from said operational region to an exchange position by using a transfer device;

transferring said transfer device to a new location relative to said operational region;

removing a series of jaw parts of said second set for achieving a new operational location for said edge pieces;

placing said edge pieces at said new operational location; and locking said edge pieces and at least those jaw parts of said second set which are at said operational region in the longitudinal direction of the bending jaws.

9. Method according to claims 1, wherein for exchanging the jaw parts of said second set which are at said operational region, further comprising the steps of:

moving at least those jaw parts of said second set at said operational region to an exchange position;

releasing at least those jaw parts of said second set locked at said operational region in the longitudinal direction;

releasing and transferring said edge pieces from said operational region to said exchange position by using a transfer device;

placing the series of jaw parts of said second set at the location previously occupied by said edge pieces;

moving said transfer device to a new location;

releasing said series of jaw parts of said send set for achieving a new operational location for said edge pieces;

placing said edge pieces at the new location from where said series of jaw parts were removed;

transferring the jaw parts of said second set from said exchange position to said operational region; and locking said edge pieces and at least those jaw parts of said second set which are at said operational region in the longitudinal direction of the bending jaws.

10. Method according to claim 8, wherein said series of removed jaw parts of said second set are stored in connection with said transfer device during the time between exchanges.

11. Method according to claim 8, wherein said series of removed jaw parts of said second set are placed relative to those jaw parts of said second set which form an extension to said edge pieces at said non-operational region.

12. Method according to claim 6, wherein the bending jaws are locked in the longitudinal direction by said transfer device with two transfer units each respectively placed at opposite ends of the jaw parts of said second set.

13. Method according to claims 8, further comprising the step of:

transferring the non-operational edge pieces towards the center part of the bending jaws to fill-in the openings left in the bending jaws by said removed edge pieces.

14. Method according to claim 8, further comprising the step of:

electing the total width of said edge piece in the longitudinal direction of the bending jaws to be substantially equal to or less than the product of the width and the number of jaw parts of said second set, according to the formula $$LM * N > C_k$$

where

LM=the number of jaw parts of said second set,

N=the width of the jaw parts of the series to be removed, and $C_k$=total width of said edge pieces.

15. Method according to claim 1, wherein for releasing jaw parts of said first set, jaw parts of said second set, and said edge pieces from said operational region, said method further comprising the steps of:

moving gripping means of first or second transfer means into locking connection with corresponding bending jaws to be exchanged;

releasing, a safety lock of each jaw part to be exchanged;

opening a first lock connecting said each jaw part to a frame in said operational region; and releasing a second lock connecting said each jaw part to said frame for bringing each said jaw part onto a support of said first or second transfer means.

16. Method according to claim 1, further comprising the step of:

carrying out substantially simultaneously the adjusting of the width of the bending jaws, and the exchange of respective jaw parts of said first set and said second set.

* * * * *